US007822606B2

(12) United States Patent
Lane et al.

(10) Patent No.: US 7,822,606 B2
(45) Date of Patent: Oct. 26, 2010

(54) METHOD AND APPARATUS FOR GENERATING AUDIO INFORMATION FROM RECEIVED SYNTHESIS INFORMATION

(75) Inventors: Frank Lane, Asbury, NJ (US); Rajiv Laroia, Far Hills, NJ (US)

(73) Assignee: Qualcomm Incorporated, San Diego, CA (US)

( * ) Notice: Subject to any disclaimer, the term of this patent is extended or adjusted under 35 U.S.C. 154(b) by 1070 days.

(21) Appl. No.: 11/487,261

(22) Filed: Jul. 14, 2006

(65) Prior Publication Data

US 2008/0015860 A1 Jan. 17, 2008

(51) Int. Cl.
*G10L 13/00* (2006.01)

(52) U.S. Cl. ..... 704/258

(58) Field of Classification Search ..... 704/258
See application file for complete search history.

(56) References Cited

U.S. PATENT DOCUMENTS

| | | | | |
|---|---|---|---|---|
| 5,406,626 | A | 4/1995 | Ryan | |
| 6,144,848 | A * | 11/2000 | Walsh et al. | 455/419 |
| 6,980,953 | B1 * | 12/2005 | Kanevsky et al. | 704/235 |
| 6,985,857 | B2 * | 1/2006 | Adut | 704/230 |
| 7,003,463 | B1 * | 2/2006 | Maes et al. | 704/270.1 |
| 7,027,568 | B1 | 4/2006 | Simpson et al. | |
| 7,107,219 | B2 * | 9/2006 | Nemoto | 704/271 |
| 7,519,536 | B2 * | 4/2009 | Maes et al. | 704/270.1 |
| 7,610,556 | B2 * | 10/2009 | Guo et al. | 715/745 |
| 7,668,718 | B2 * | 2/2010 | Kahn et al. | 704/270 |
| 7,672,436 | B1 * | 3/2010 | Thenthiruperai et al. | 379/88.04 |
| 2002/0055844 | A1 | 5/2002 | L'Esperance | |

FOREIGN PATENT DOCUMENTS

| | | |
|---|---|---|
| EP | 0901000 | 3/1999 |
| EP | 1168297 | 2/2002 |
| GB | 2246273 | 1/1992 |

OTHER PUBLICATIONS

International Search Report—PCT/US07/073527, International Search Authority—European Patent Office, Sep. 9, 2008.
Written Opinion—PCT/US07/073527, International Search Authority—European Patent Office, Sep. 9, 2008.

(Continued)

*Primary Examiner*—Susan McFadden
(74) *Attorney, Agent, or Firm*—Kam T. Tam

(57) ABSTRACT

Methods and apparatus for providing enhanced audio are described. In some embodiments speech synthesis information is used to provide user control of attributes of received broadcast speech, such as language, tone, speed, gender, and volume. In other embodiments, speech synthesis information is transmitted prior to a broadcast audio signal, allowing the receiving node to substitute synthesized speech for the broadcast audio signal if there is an interruption in the audio signal. Still other implementations allow for the synthesizing of speech that is different than the broadcast audio signal, such as background information, associated local information, title, author, etc. Other embodiments allow for the simultaneous transmission of multiple speech programming in a single transmission stream, allowing the user to select one program from the transmitted set of programs for synthesizing speech representative of the selected program.

22 Claims, 15 Drawing Sheets

OTHER PUBLICATIONS

Kase, et al., "InfoMirror—Agent-Based Information Assistance to Drivers," 1999 IEEE/IEEJ/JSAI International Conference on Intelligent Transportation Systems, 1999 Proceedings, Tokyo, Japan, Oct. 5-8, 1999, pp. 734-739.

Li Deng, et al., "Distributed Speech Processing in miPad's Multimodal User Interface," IEEE Transactions on Speech and Audio Processing, New York, NY, vol. 10. issue 8, Nov. 2002, pp. 605-819.

* cited by examiner

600

| | 602 | 604 | 606 | 608 |
|---|---|---|---|---|
| 610 | REGION 1 e.g. ZIP CODE 1 or NAME 1 | SPORTS | LOCAL REGION 1 SPORTS INFO | MALE, SPEECH RATE 2, REGION 1 DIALECT INFO |
| 612 | REGION 2 e.g. ZIP CODE 2 or NAME 2 | WEATHER | LOCAL REGION 2 WEATHER INFO | FEMALE, SPEECH RATE 2. REGION 2 DIALECT INFO |
| 614 | REGION ID | INFO TYPE | INFORMATION COMMUNICATED | SPEECH SYNTHESIS INFORMATION, e.g., VOICE, GENDER, SPEECH RATE, DIALECT |
| 616 | REGION ID | INFO TYPE | INFORMATION COMMUNICATED | SPEECH SYNTHESIS INFORMATION, e.g., VOICE, GENDER, SPEECH RATE, DIALECT |
| 618 | REGION ID | INFO TYPE | INFORMATION COMMUNICATED | SPEECH SYNTHESIS INFORMATION, e.g., VOICE, GENDER, SPEECH RATE, DIALECT |
| 620 | REGION ID | INFO TYPE | INFORMATION COMMUNICATED | SPEECH SYNTHESIS INFORMATION, e.g., VOICE, GENDER, SPEECH RATE, DIALECT |
| 622 | REGION ID | INFO TYPE | INFORMATION COMMUNICATED | SPEECH SYNTHESIS INFORMATION, e.g., VOICE, GENDER, SPEECH RATE, DIALECT |

Fig. 6

METHOD AND APPARATUS FOR GENERATING AUDIO INFORMATION FROM RECEIVED SYNTHESIS INFORMATION

FIELD OF THE INVENTION

This invention relates to communications systems and, more particularly, to methods and apparatus for improving the delivery of enhanced audio information.

BACKGROUND

Audio programming is typically broadcast from a central point to multiple receiving points. In wireless systems, such as broadcast radio and TV (satellite or terrestrial), or wireless cellular broadcast systems, the audio programming is sampled and compressed for transmission. It is then processed at the receiving end to reproduce the audio programming. This process uses significant transmission bandwidth, especially for high fidelity audio reproduction. Where speech is the audio programming, the speaker is identifiable from the reproduced audio at the receiving end. However, along with the high bandwidth required to transmit high fidelity audio, the receiving devices generally only reproduce the original audio. The user at the receiving end cannot control the gender, inflection, tone, speed, language, etc. of the broadcast audio speech. Further, because of the high bandwidth required, there are only a limited number of channels available to transmit a limited array of audio selection.

It is well known in the art to represent audio speech with text or phonetic symbols. These representations can then be processed in speech synthesizers to produce audible speech. It is also well known to apply various parameters to the synthesization process in order to produce speech with various alternative attributes, such as gender, inflection, speed, tone, volume, etc. It is also known that speech synthesis from representative symbols can be accomplished in any language, by changing the symbology selection, such as by using alternative phonetic representations.

It is also known that broadcast TV and radio stations are often networked and syndicated, resulting in broadcasts that are nationwide. In this process, local information (local sports, news, weather, etc.) is often not provided to listeners or viewers.

A common problem of broadcast audio is the chance that the transmission will be interrupted, such as when a vehicle enters a tunnel or goes behind a structure. Since it is a broadcast situation (the receiving device cannot generally send a signal to the broadcast transmitter requesting a re-transmission), the audio transmitted during the interruption will be lost.

In view of the above discussion, it should be appreciated that there is a need for new and improved ways of transmitting audio information, either alone or in combination with transmitted video programming.

SUMMARY

The above problems and limitations are greatly alleviated by various implementations. Some embodiments entail transmitting speech synthesis information, typically in a broadcast scenario, either instead of, or in addition to, broadcast audio. The speech synthesis information can be either text or phonetic representations of speech. If text-based, control information (such as speech parameters) can be applied at the receiving end to modify the presentation of the synthesized speech. For instance, to make the resultant synthesized voice more esthetically pleasing, speech synthesis information may be alternatively presented as a male or female voice, in various dialects (southern U.S. inflections, for example), in various tones (harsh, demanding voice, or soft, comforting voice, as examples), at a chosen speed, etc. These parameters can be broadcast with the speech synthesis information, or can be supplied by the receiving device, or some combination of the two. The received speech synthesis information can either be synthesized in real time, or stored for later retrieval. Additionally, the stored speech synthesis information can be utilized to allow a user to pause, rewind, or fast forward the synthesized voice.

In some embodiments, text-based speech synthesis information is sent to multiple receiving nodes or stations, and each station can select which speech parameters to apply to the speech synthesis information, resulting in a variety of possible audio speech outputs at the various receiving nodes. Because of the relatively small bandwidth required to transmit speech synthesis information as opposed to audio, multiple programming can be sent simultaneously (or effectively simultaneously, whereby each program can be synthesized in "real time" at the receiving end). For instance, a speech can be broadcast in several languages simultaneously, with minimal bandwidth, if accomplished by transmitting speech synthesis information. Alternatively, local news, sports, and weather can be broadcast to multiple localities, and each receiving device can select which programming to use for its voice synthesis. Alternatively, one or more books could be transmitted along with the news or sports, either for real time audible rendering, or downloaded for later listening.

Further, because the required bandwidth is relatively small, additional information can be sent along with the speech synthesis information representing the target speech. For instance, the speech control parameters can be sent along with text-based speech synthesis information. Information about the program can be included as additional speech synthesis information so that this information (e.g., author, title, classification) can be synthesized into speech at the request of the receiving user. Also, synchronization information, encryption controls, copyright information, etc. can be included with the speech synthesis information transmission.

Another embodiment involves transmitting broadcast audio along with speech synthesis information that matches, or partially matches, the broadcast audio. If the speech synthesis information matching the broadcast audio signal is transmitted before the corresponding broadcast audio, and the broadcast audio transmission is interrupted, the receiving device can revert to the previously received speech synthesis information, send it to the synthesizer, and pick up with synthesized speech at the point where the broadcast audio was interrupted.

In another embodiment, the speech synthesis information could match the broadcast audio, such as the audio portion of a video/audio broadcast, except that it would be in a different language. By sending multiple speech synthesis information streams simultaneously, each in a different language, a receiving user could select the language that he wished to hear (by selecting the speech synthesis information associated with that language and synthesizing that information into speech) while viewing the video programming. This could be accomplished in existing technology, such as by incorporating the speech synthesis information in the communications channel of an MPEG transmission, for example.

Additional features and benefits of the present invention are discussed in the detailed description which follows.

BRIEF DESCRIPTION OF THE DRAWINGS

FIG. 6 illustrates identification information associated with transmitted speech synthesis information in accordance with various embodiments.

DETAILED DESCRIPTION

The methods and apparatus of various embodiments for enhanced audio capabilities can be used with a wide range of digital communications systems. For example, the invention can be used with digital satellite radio/TV broadcasts, digital terrestrial radio/TV broadcasts, or digital cellular radio systems. Any systems which support mobile communications devices such as notebook computers equipped with modems, PDAs, and a wide variety of other devices which support wireless interfaces in the interests of device mobility can also utilize methods and apparatus of various embodiments.

Figure 1:
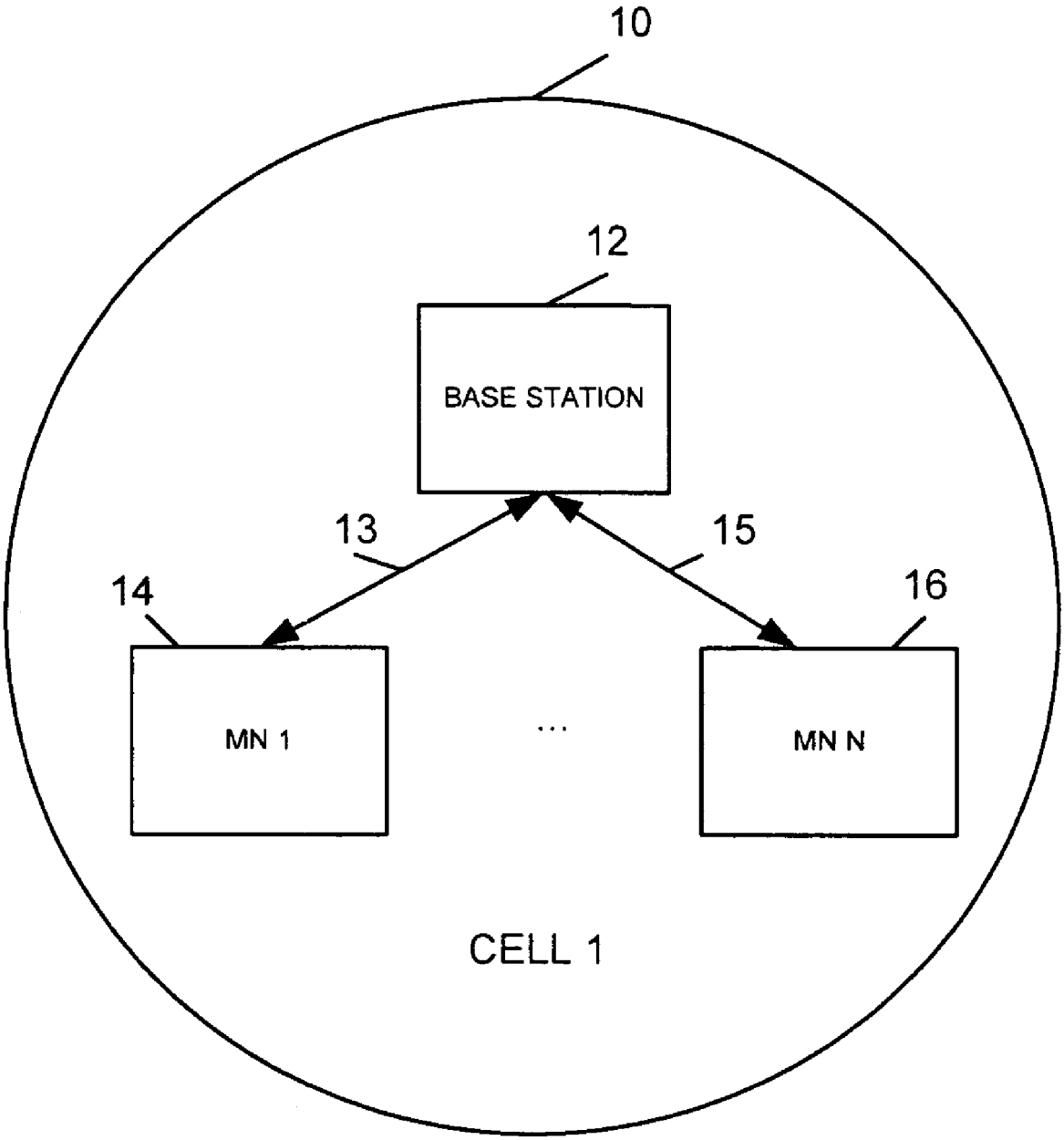
FIG. 1 illustrates a network diagram of an exemplary communications system implemented in accordance with various embodiments.

FIG. 1 illustrates an exemplary communication system 10 implemented in accordance with various embodiments, e.g., a cellular communication network, which comprises a plurality of nodes interconnected by communications links. A communications system may include multiple cells of the type illustrated in FIG. 1. The communications cell 10 includes a base station 12 and a plurality, e.g., a number N, of mobile nodes 14, 16 which exchange data and signals with the base station 12 over the air as represented by arrows 13, 15. The network may use OFDM signals to communicate information over wireless links. However, other types of signals, e.g., CDMA signals, might be used instead. Nodes in the exemplary communication system 100 exchange information using signals, e.g., messages, based on communication protocols, e.g., the Internet Protocol (IP).

The communications links of the system 10 may be implemented, for example, using wires, fiber optic cables, and/or wireless communications techniques. In accordance with various embodiments, the base station 12 and mobile nodes 14, 16 are capable of performing and/or maintaining control signaling independently of data signaling, e.g., voice or other payload information, being communicated. Examples of control signaling include speech synthesis information, which may include text or phonetic representation of speech, timing information, synthesis parameters (tone, gender, volume, speech rate, local inflection, etc.), and background information (subject matter classifications, title, author, copyright, digital rights management, etc.). The representations of speech may utilize ASCII or other symbology, phonemes, or other pronunciation representations.

Figure 2:
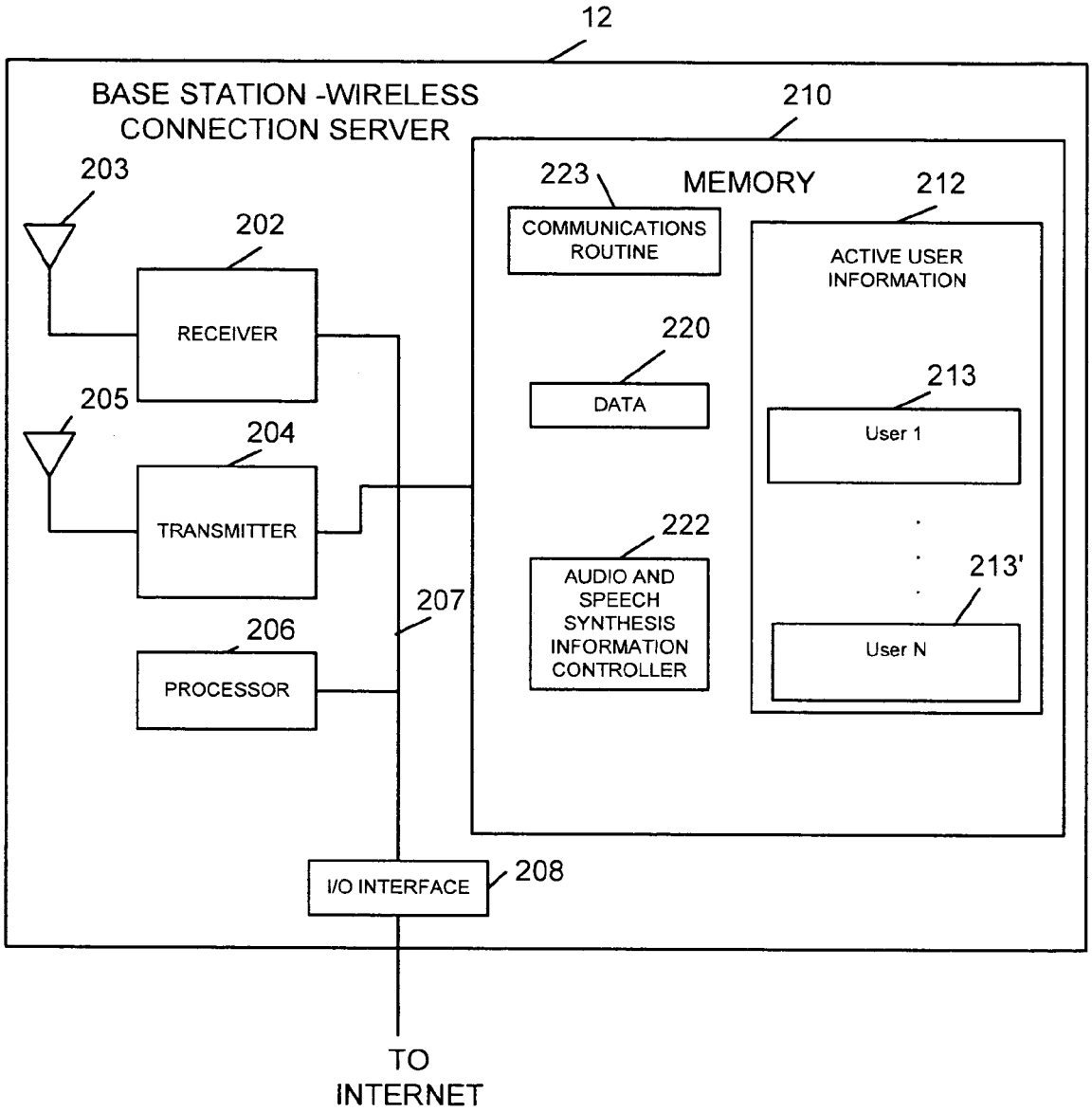
FIG. 2 illustrates an exemplary base station implemented in accordance with various embodiments.

FIG. 2 illustrates an exemplary base station 12 implemented in accordance with various embodiments. As shown, the exemplary base station 12 includes a receiver module 202, transmitter module 204, processor 206, memory 210 and a network interface 208 coupled together by a bus 207 over which the various elements may interchange data and information. The receiver module 202 is coupled to an antenna 203 for receiving signals from mobile nodes. The transmitter module 204 is coupled to a transmitter antenna 205 which can be used to broadcast signals to mobile nodes. The network interface 208 is used to couple the base station 12 to one or more network elements, e.g., routers and/or the Internet. In this manner, the base station 12 can serve as a communications element between mobile nodes serviced by the base station 12 and other network elements. Some embodiments may be, and sometimes are, implemented in a broadcast-only mode, and in such case there may be no need for receiving module 202 or antenna 203.

Operation of the base station 12 is controlled by the processor 206 under direction of one or more routines stored in the memory 210. Memory 210 includes communications routine 223, data 220, audio and speech synthesis information controller 222, and active user information 212 (which may also be unnecessary in a broadcast-only implementation). Data 220 includes data to be transmitted to one or more mobile nodes, and comprises broadcast audio signals (typically in sampled, compressed format) and speech synthesis information. The broadcast audio could also be, and in some embodiments is, replaced by broadcast video with associated broadcast audio (e.g., MPEG formatted materials). In this case, the voice synthesis information could be carried in the control channels of such a transmission.

The audio and speech synthesis information controller 222 operates in conjunction with active user information 212 and data 220. The controller 222 is responsible for determining whether and when mobile nodes may require enhanced audio services. It may base its decision on various criteria such as, requests from mobile nodes requesting enhanced audio, available resources, available data, mobile priorities etc. These criteria would allow a base station to support different quality of service (QOS) across the mobile nodes connected to it. Alternatively, base station 12 could operate in a broadcast-only mode, in which case it would transmit the enhanced audio services to all mobile nodes, thereby eliminating the need for active user information 212.

If enhanced (voice synthesis supported) audio services are to be provided, controller 222 would extract the appropriate data from data 220 (described in greater detail in relation to FIGS. 4-7). For instance, one type of enhanced audio might comprise broadcasting speech synthesis information representing a selection of audio speech to multiple mobile nodes in multiple languages. Under this scenario, each receiving mobile node could select a preferred language, and strip out the speech synthesis information corresponding to that language for voice synthesis. To accomplish this, controller 222 would select the appropriate data from data 220 to construct the appropriate speech synthesis information for broadcast by transmitter 204.

Another type of enhanced audio might be to broadcast to multiple mobile nodes speech synthesis information corresponding to a portion of speech, followed by a time-delayed broadcast of the audio speech signal (sampled and compressed audio). In this way, a receiving node could store the received speech synthesis information representation of the speech, and then play the audio speech to a user at the receiving node device. If the reception of the audio speech is then interrupted, such as by the user entering a tunnel which blocks incoming wireless signals, the receiving node could detect the interruption, and begin synthesizing speech from the speech synthesis information representation of the speech received previously, starting at the point that the interruption occurred. In this way, the user at the mobile node would not miss any portion of the speech, although the synthesized speech would not be in the voice of the original speaker, as represented by the broadcast audio speech. In this implementation of enhanced audio service, controller 222 would select the appropriate speech synthesis information and its corresponding audio signal from data 220, and controlling the delay between the two streams, direct the transmission of both streams by transmitter 204.

Still another type of enhanced audio might be to broadcast to multiple mobile nodes speech synthesis information corresponding to a portion of audio speech, wherein the speech synthesis control information includes synthesis parameters variously representing gender, tone, volume, speech rate, local inflections, etc. Alternatively, some or all of the synthesis parameters could be supplied locally by the mobile node. In this way, the receiving mobile node can receive the speech synthesis information representation of speech, choose among the associated parameters, and synthesize the speech according to the selected parameter(s). In this way, the user at the mobile node could control aspects of the delivery of audio information from the base station 12. This would allow one mobile node to produce a different audio rendition of the speech than another mobile node. For example, one user could synthesize the speaker as a male, while another user could synthesize the same received content in a female voice.

Yet another type of enhanced audio might be to broadcast audio signals to multiple mobile nodes, along with corresponding background information included in transmitted speech synthesis information. Such background information might be audio classification (sports, weather, book, etc.), title, author, copyright, digital rights management, encryption controls, etc. The background information could also contain data to be used by the mobile node to control the synthesis process, such as security controls, encryption, audio classification, etc., or could be data subject to synthesis as additional audio material available to the user at the mobile node, such as the title or author of the broadcast or of the synthesized audio program material.

Active user information 212 includes information for each active user and/or mobile node serviced by the base station 12. For each mobile node and/or user it includes the enhanced audio services available to that user, as well as any user preferences regarding speech synthesis parameters, to the extent that those parameters are to be implemented at the base station 12. For instance, a subset of users may prefer enhanced audio in Spanish in a male voice, spoken quickly. Another subset of users may prefer enhanced audio in English, in a female voice, and in a Southern U.S. dialect or inflection. The base station 12 could either send speech synthesis information in each language to all mobile nodes (broadcast mode) along with synthesis control parameters for each of the other preferences described above, or could tailor transmissions to subsets of receivers having similar preferences.

Figure 3:
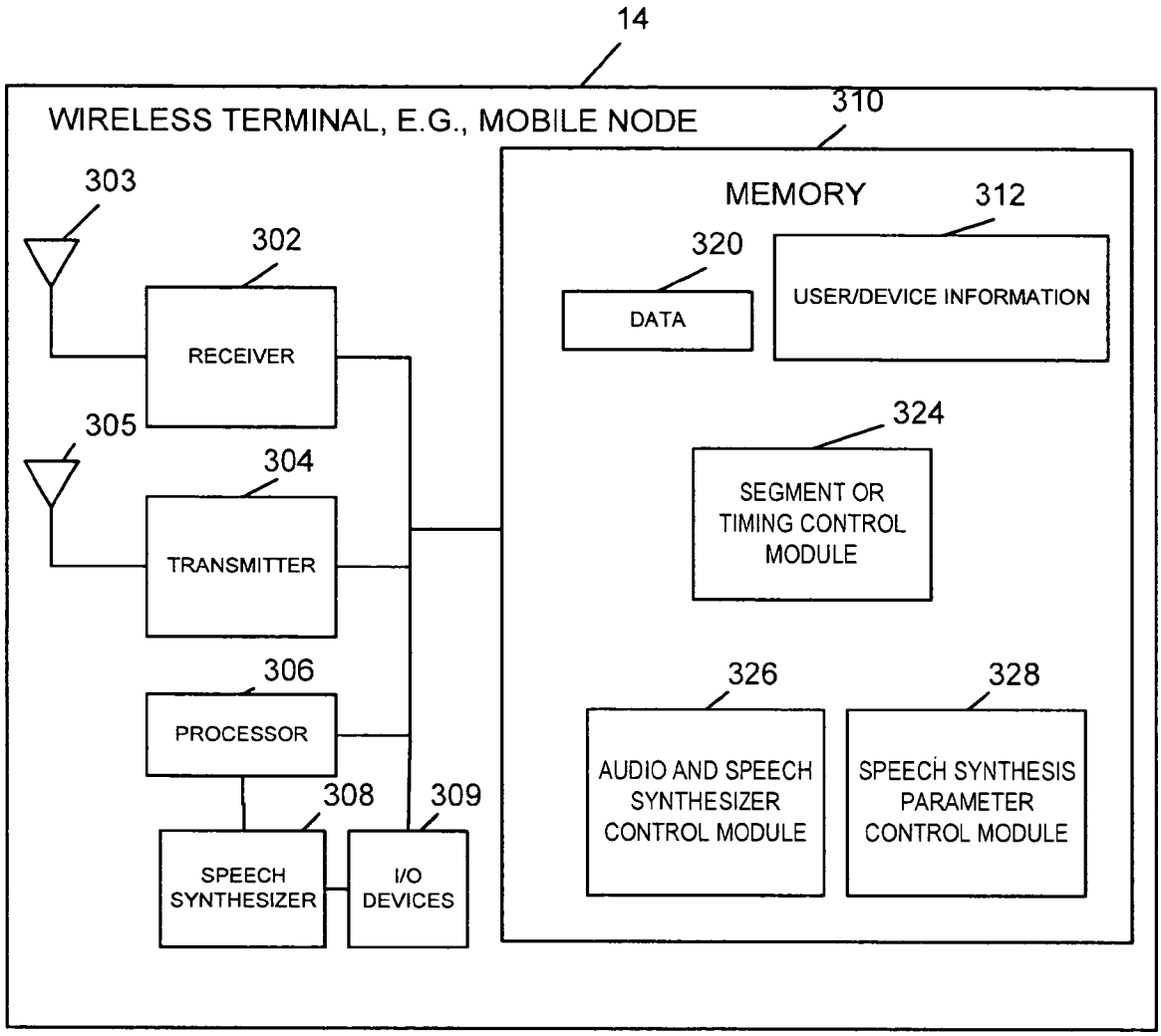
FIG. 3 illustrates an exemplary mobile node implemented in accordance with various embodiments.

FIG. 3 illustrates an exemplary wireless terminal, e.g., mobile node 14 implemented in accordance with various embodiments. The mobile node 14 includes a receiver 302, a transmitter 304, speech synthesizer 308, antennas 303, 305, a memory 310, user I/O devices 309 and a processor 306 coupled together as shown in FIG. 3. The mobile node uses its transmitter 306, receiver 302, and antennas 303, 305 to send and receive information to and from base station 12. Again, in a broadcast-only implementation, the transmitter 304 and antenna 305 would not be necessary.

Memory 310 includes user/device information 312, data 320, segment or timing control module 324, audio and speech synthesis control module 326, and a speech synthesis parameter control module 328. The mobile node 14 operates under control of the modules, which are executed by the processor 306. User/device information 312 includes device information, e.g., a device identifier, a network address or a telephone number. This information can be used by the base station 12 to identify the mobile nodes, e.g., when assigning communications channels. The data 320 includes, e.g., user preferences regarding choices among speech synthesis parameters, and locally stored speech synthesis parameters (if any).

Audio and speech synthesis control module 326 determines, in conjunction with signals received from the base station 12 and user inputted data 320, whether mobile node 14 will be receiving enhanced audio service signals, the format of such signals, the allocation of the speech synthesis parameters (which ones will be controlled at base station 12 and which ones controlled at mobile node 14), and the control of any background information. In conjunction with segment or timing control module 324, module 326 will cause processor 306 to select the appropriate incoming data streams for delivery to the user (such as received broadcast audio) and delivery to speech synthesizer 308 (speech synthesis information), or both.

Speech synthesis parameter control module 328 inputs the appropriate synthesis parameters (as received from base station 12 and/or extracted locally from data 320) to speech synthesizer 308, for processing and delivery to the user of mobile device 14. Data 320 can also be used to store received speech synthesis information for later synthesis and playback.

Figure 4:
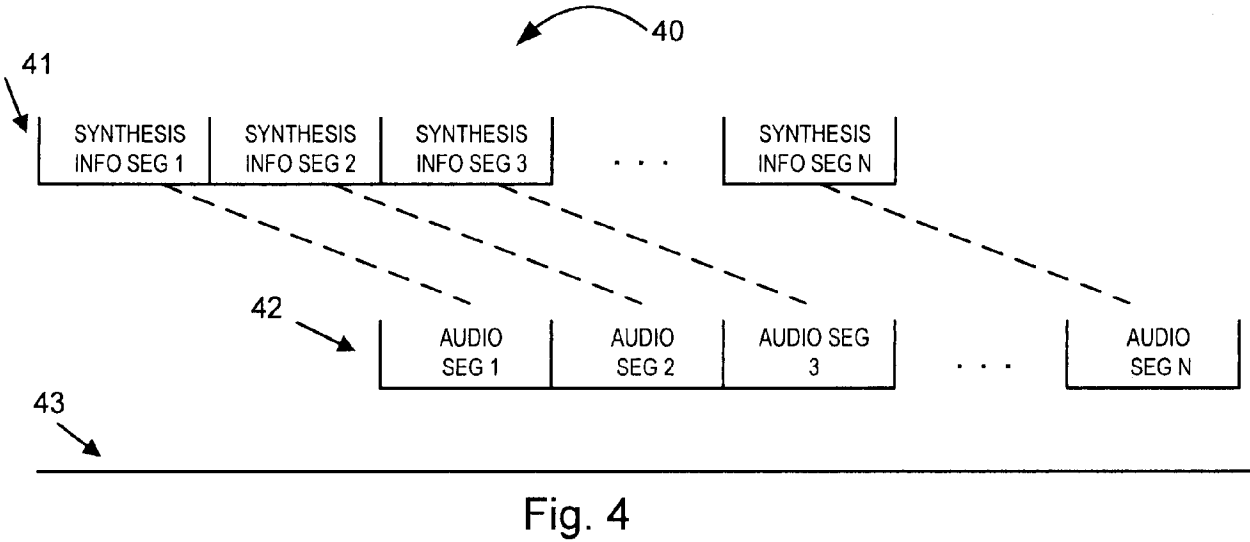
FIG. 4 illustrates an audio material segmentation process in accordance with various embodiments.

FIG. 4 is a depiction of segmented broadcast audio signals and speech synthesis information corresponding to the broadcast audio. As described earlier, one implementation is to transmit to multiple receiving nodes speech synthesis information associated with a speech program, and then, after a delay, broadcast the audio speech program to the receiving nodes. In this way, if the transmission of the broadcast audio program is interrupted, such as by the receiving node losing radio contact with the transmitting node (such as by going into a tunnel or passing behind a building or hill, for example), the receiving node can detect the interruption, identify the interruption point in the received and stored speech synthesis information corresponding to the broadcast audio, and begin synthesizing and presenting the synthesized audio to the user of the receiving device starting at the point of interruption. Meanwhile, another receiving device that didn't lose radio contact would continue to present the broadcast audio to its user. In a similar manner, the receiving device that suffered the interruption could identify the resumption of broadcast audio, and revert to that signal immediately.

Segmented data 41 represents numbered segments of speech synthesis information associated with the broadcast audio program. Segmented audio stream 42 represents the segmentation of the sampled, compressed broadcast audio program, wherein each segment is numbered and associated with the speech synthesis information segment of the same number. However, transmission of the stream 42 segments to the receiving nodes is time delayed from the transmission of segment stream 41. This delay can be anything from less than one second to several minutes, and is intended to allow for the continuation of synthesized audio in the event of an interruption in the reception of the broadcast audio.

One method of accomplishing this would be to delay the transmission of stream 42 for at least as long as the longest anticipated interruption of transmission. For instance, if each segment is 2 seconds long, and anticipated interruptions may be 4 seconds long, then the delay should be 4 seconds, or 2 segments, as is shown in FIG. 4. If in FIG. 4 the synthesis segments 41 are buffered or stored as they are received, with a buffer size of 2 segments, then if the transmission of audio segments 1 and 2 of stream 42 (and therefore synthesis information segments 3 and 4 of stream 41) is not received, the buffer will contain synthesis information segments 1 and 2. The receiving node can then synthesize the buffered segments (1 & 2) and play them to the user, and when transmission is restored at audio segment 3 of stream 43, revert to that and subsequent audio segments to play to the user. In this way, the user will receive all segments of the audio program, although segments 1 and 2 will be in a synthesized voice, rather than in the compressed audio of the audio segment stream.

Alternatively, instead of physically segmenting the streams, timing could be used to designate, based on the delay, the point at which the stored synthesis information should be played to the user, to coincide with the point of interruption. Also, it would be consistent with various embodiments to send the synthesis information segments to the receiving node and store them prior to sending the audio segments. In this way, any length of interruption of audio could be remedied with synthesized audio of the interrupted portion.

Figure 5:
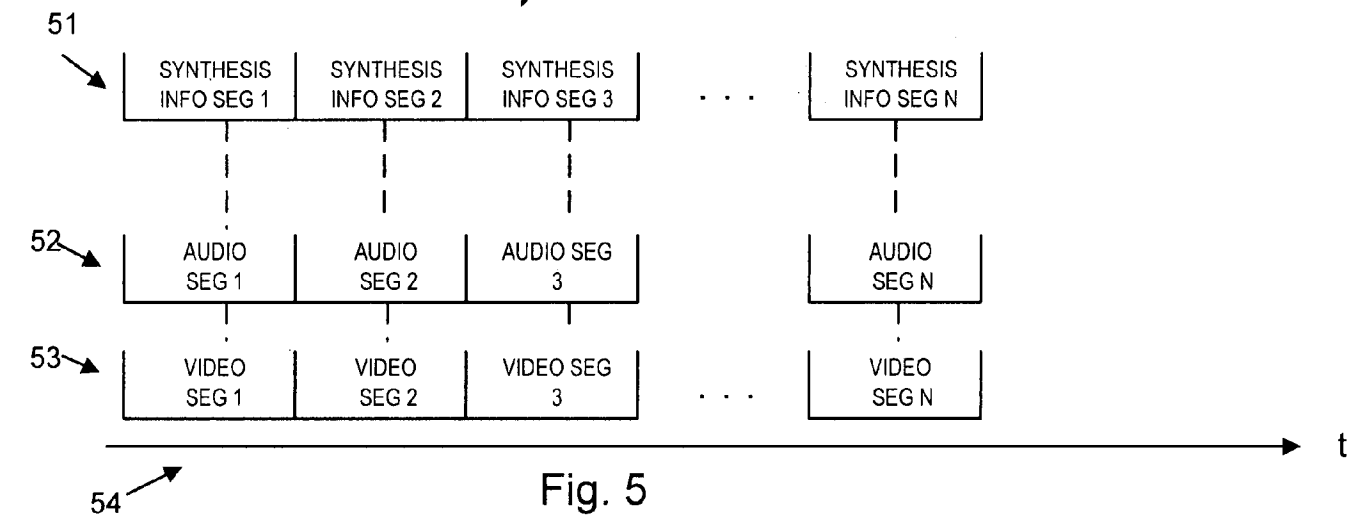
FIG. 5 illustrates an audio material segmentation process in accordance with various embodiments.

FIG. 5 shows an approach to serving alternative embodiments. As described previously, the programming might be video and audio, such as by using MPEG technology. This description would be equally applicable to digital audio transmissions that simultaneously transmit data, such as voice over data systems. In the case of MPEG video, there would be a stream 53 of the video, broken up into segments by number, and a simultaneous stream 52 of audio, broken up into segments with corresponding identification numbers. Additionally, there could be a simultaneous transmission of speech synthesis information (segment stream 51) in the control data portion of the signal (sometimes referred to as overhead, maintenance, or low speed data portions), representative of all or part of the audio, and further including synthesis control parameters and/or background information.

This, in conjunction with any receiving node-supplied synthesis control parameters, would allow the user to be presented with various enhanced options regarding the audio portion of the program. These options might include choice of language, gender, tone, rate of speech, and the provision of additional information concerning the program, such as title, author, classification, local news or weather, etc. These selections could be made by the user by, for instance, inputting from a keypad or other control device. Further, the background information in the speech synthesis information could include choices to be presented to the user on such a keypad or other control device.

FIG. 6 shows an implementation of one embodiment of the transmission from a base station. In this embodiment, speech synthesis information may include many phonetic representations of several speech programs. Because phonetic representations of speech (as well as text representations of speech) use so little bandwidth compared to typical sampled, compressed audio renditions of speech, many versions of the same speech program or different speech programs may be broadcast to multiple receiving nodes simultaneously. For instance, in the cellular radio environment, OFDM technology could be used to simultaneously transmit various streams of speech synthesis information representing various streams of audio speech. Additionally, background information and/or synthesis control information can be interleaved or woven into the same transmission.

FIG. 6 shows in drawing 600 a portion of the background information of the speech synthesis information broadcast to receiving nodes. Specifically, it shows identification information of the associated speech synthesis information. Each row is associated with a stream of speech synthesis information containing a representation of a speech program. The speech program can be represented by speech synthesis information comprising phonetic representations of the speech, or by a textual representation of the speech, with associated synthesis parameters. In the former case, the speech synthesizer would use the information to directly produce speech. In the latter case, the parameters could be used by the speech synthesizer along with the textual representation to produce the speech. If synthesis parameters are used, they can be transmitted as part of the speech synthesis information, supplied by the receiving node, or a combination of the two.

Each row describes various attributes of the resultant speech (as generated by the speech synthesizer). Specific exemplary attributes have been listed in the first two rows for the purposes of illustration. For example, row 610 shows that the associated speech synthesis information represents a male voice, with the rate of speech set at speed number 2, and with the dialect or inflection of region 1 (such as South U.S., for example). The speech synthesis information associated with row 612 is identified in column 608 as representing a female voice, also at speech rate 2, but with the dialect of region 2 (such as the Midwest U.S., for example). As described above, these sets of attributes of the speech could be incorporated in the phonetic representation of the speech (in which case each set of rows 610 and 612 attributes would have an associated transmission stream of phonetic symbols), or added to the textual representation of speech by applying the synthesis parameters (in which case there would be just one transmission of the textual representation of speech for rows 610 and 612, allowing the synthesizer to produce either of the two sets of attributes associated with rows 610 and 612). The other rows 614, 616, 618, 620, 622 of column 308 represent other combinations of these speech attributes, or other attributes such as volume, alternative languages, etc.

Column 602 depicts the identification of the region (by zip code, name, etc.) associated with the speech synthesis information associated with each row. Because the speech attributes of row 610 represent the dialect of region 1, column 602 identifies row 610 as relating to region 1. Column 604 depicts the classification of the speech synthesis information associated with each row. The first stream of speech attributes (row 610) contains programming of sports. The second set of speech attributes (row 612) contains speech programming of weather. Column 606 identifies the geographical classification of the programming represented in each row. Row 610 shows that the sports (identified in column 604) are local, as opposed to national or international. Similarly, row 612 of column 606 shows that the associated speech relates to local weather from region 2, as opposed to national or international weather.

The information in FIG. 6 is broadcast along with the speech synthesis information stream(s), in order for the receiving node to be able to provide choices to the user, so that the user can select from the attributes described above in relation to FIG. 6. For example, if the user wants to hear local weather for region 2 in a female voice, at "speed 2", and in the dialect of region 2, the user would select the attributes of row 612. In the case of speech synthesis information comprising phonetic representations of the speech, the receiving node would select the speech synthesis information stream associated with row 612 and send it to the speech synthesizer. In the case of speech synthesis information comprising textual representations of the speech, the receiving node would select the speech synthesis information associated with row 612, and apply the parameters of column 608 (either stored locally or received as part of the speech synthesis information stream), providing both to the speech synthesizer. In this way, the same stream of textual speech synthesis information could be used by one receiving node to produce the attributes of column 608, row 610, and another receiving node could produce speech with the attributes of column 608, row 612.

Figures 7, 7A, 7B:
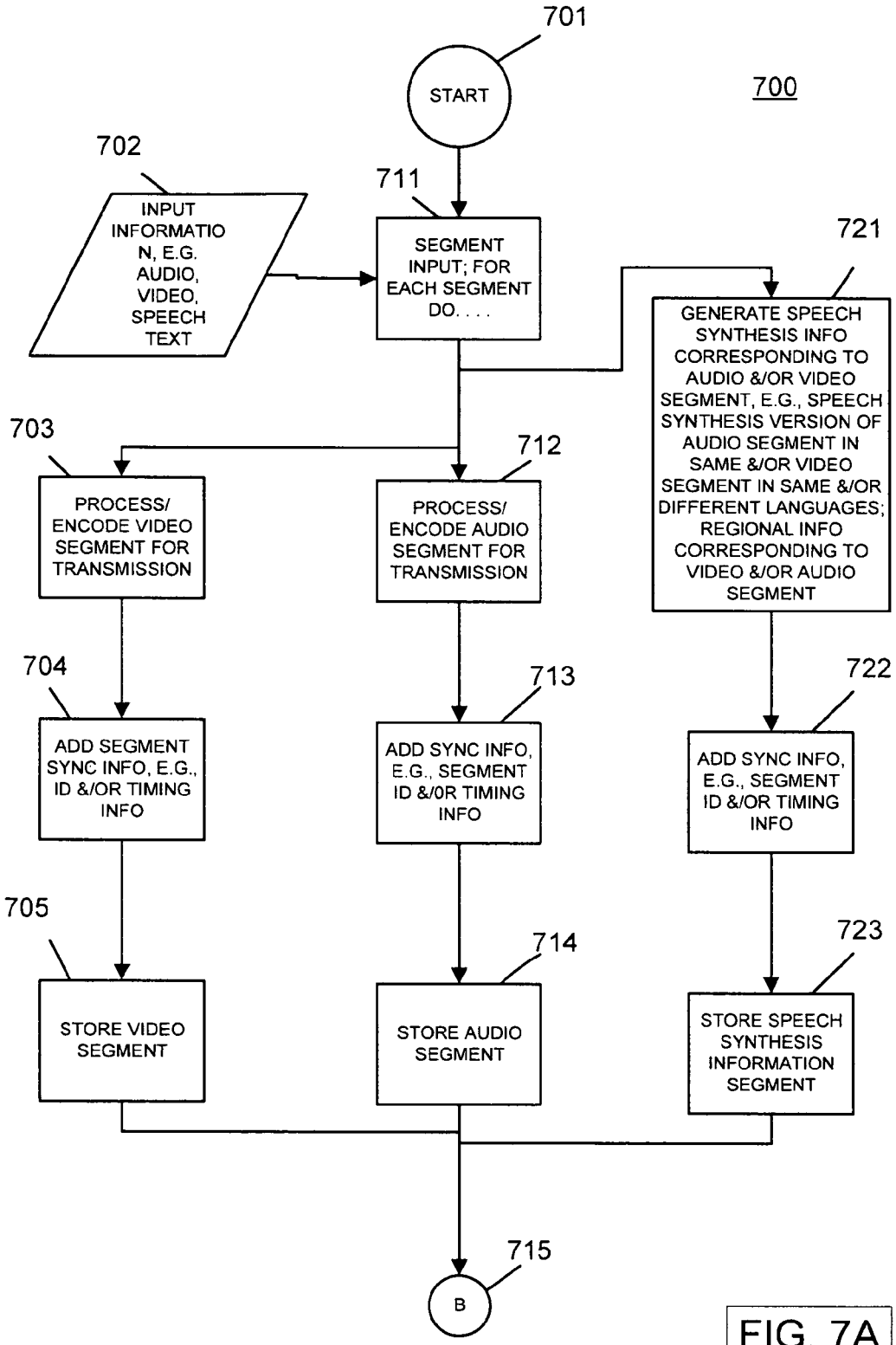
FIG. 7 illustrates a process of segmenting audio/video and associated speech synthesis information in accordance with various embodiments.
Figure 7B:
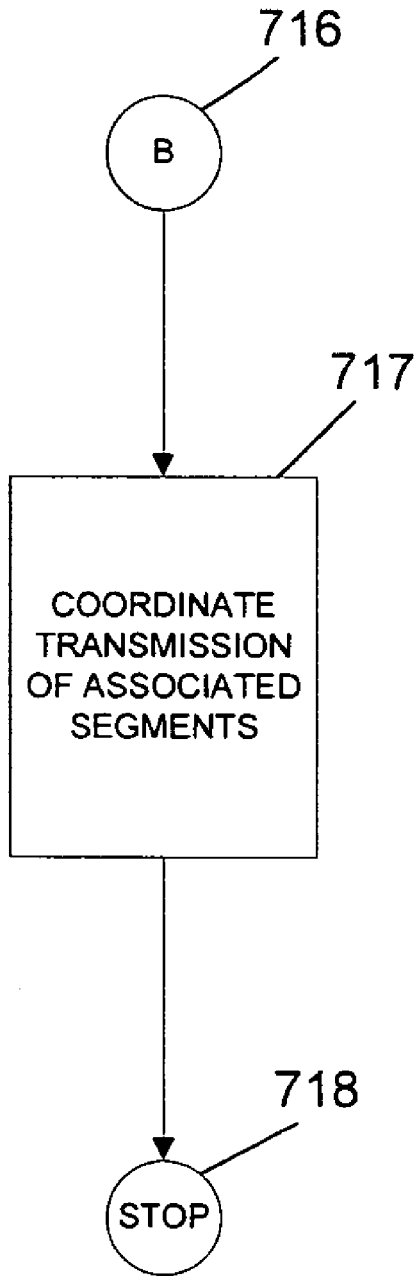

FIG. 7 comprising the combination of FIG. 7A and FIG. 7B depicts a process 700 which would segment audio/video material and accompanying information for broadcast transmission as shown in FIGS. 4 and 5. Operation of procedure 700 starts in step 701 and proceeds to step 711. A first portion of the material and information of 702 would be retrieved in step 711. The video material would be processed and encoded into a segment suitable for transmission in step 703, and step 704 would add segment synchronization information, such as the timing of the segment, a segment identification designation, etc. The video segment would then be stored in step 705.

The audio material portion would be processed at step 712, where it would be encoded (sampled, compressed, etc.) into a segment suitable for transmission. Step 713 would add segment synchronization information, such as the timing of the segment, a segment identification designation, etc. The audio segment would then be stored in step 714.

The information portion of the input information would be used in step 721 to generate speech synthesis information corresponding to the audio portion of step 712. For instance, the speech synthesis information could represent the audio portion of the material, or could represent alternative audio for the video/audio materials (alternate language, background information, local information, classification or identification information, etc.). Further, the information could include that information to be used by the receiving node or the user of the receiving node to identify the associated material, for security purposes, or for timing and synchronization purposes, or to incorporate or control the speech synthesis parameters. Step 722 would add segment synchronization information, such as the timing of the segment, a segment identification designation, etc. The information segment would then be stored in step 723. Operation proceeds from step 705, 714 and 723 to step 717 via connecting node B 715. In step 717, the video, audio, and information segments would be coordinated for transmission purposes. Alternatively, if timing information rather than segmentation is used, step 717 would coordinate the transmission of the materials and information in accordance with such timing information.

Figure 8:
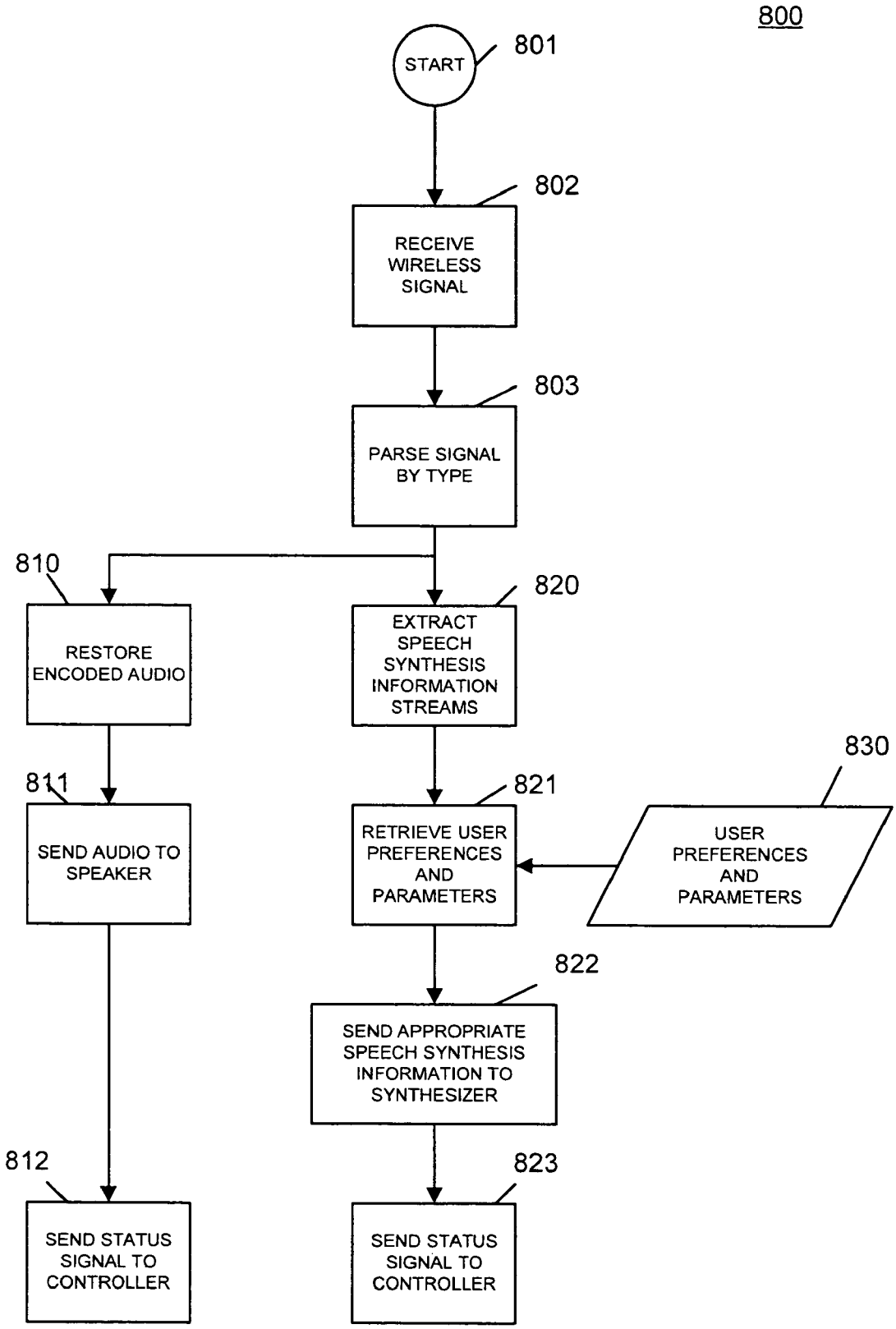
FIG. 8 illustrates a process of receiving and presenting audio and associated speech synthesis information in accordance with various embodiments.

FIG. 8 shows a process 800 for receiving and presenting a broadcast audio signal and associated speech synthesis information. The signal and information is received in step 802, and parsed by type (broadcast audio and speech synthesis information) in step 803. The audio signal is restored from its encoded state at step 810, and is sent to a speaker at the receiving device in step 811. In step 812, a status signal is sent to a controller, identifying whether the broadcast audio is usable, and the timing/segment of the audio that was sent to the speaker.

Meanwhile, step 820 extracts the various speech synthesis information streams. For example, one stream might contain equivalent speech to the broadcast audio, but in a different language. Another stream might contain additional information regarding the broadcast that may be synthesized and played to the user upon request. Other speech synthesis information may include speech parameters, security information, content classifications, etc.

User preferences and locally stored parameters 830 are retrieved in step 821. The user preferences could be stored or keyed in by the user in real-time. Based on these preferences, and the various types of speech synthesis information received, step 822 sends the appropriate speech synthesis information to the voice synthesizer. This may include text-based or phonetic representations of speech, and any appropriate speech parameters, either from local storage or as received within the speech synthesis information in step 802.

In step 823, the description of synthesizer content and associated control speech synthesis information is sent to the controller. The controller is then in a position to determine whether to send the output of the synthesizer to the speaker in place of the broadcast audio. For example, if the system is set up to receive the speech synthesis information associated with a given segment of broadcast audio prior to the reception of the audio in step 802, and the controller learns in step 812 that the audio has been interrupted, the controller can send the appropriate output from the synthesizer to the speaker, so that the user doesn't miss any audio material.

In another embodiment, if the broadcast audio is in English, and the user has designated Spanish as his preferred language in step 821 (and therefore the speech synthesis information associated with the Spanish equivalent of the broadcast audio has been sent to the synthesizer in step 822), the controller can send the output of the synthesizer to the speaker in place of the broadcast audio.

In still another embodiment, if the speech synthesis information extracted in step 820 contains local information, such as local weather, and the user has indicated a preference to hear the weather rather than the broadcast audio in step 821 (and therefore this speech synthesis information was sent to the synthesizer in step 822), the controller can send that output from the synthesizer to the speaker in place of the broadcast audio.

Figure 9:
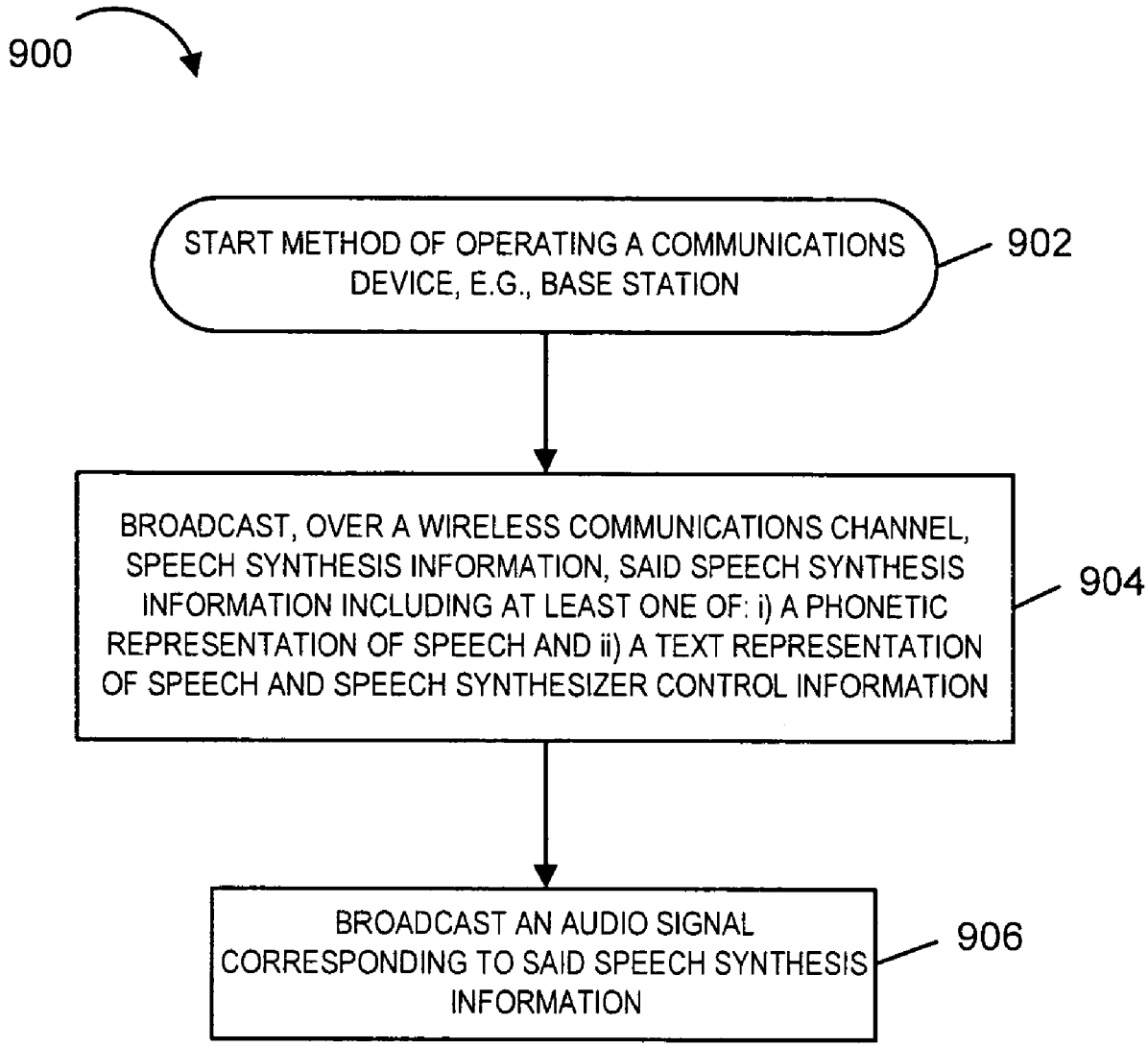
FIG. 9 is a drawing of a flowchart of an exemplary method of operating a communications device, e.g., a base station, in accordance with various embodiments.

FIG. 9 is a drawing of a flowchart 900 of an exemplary method of operating a communications device, e.g., a base station, in accordance with various embodiments. Operation starts in step 902, where the communications device is powered on and initialized. Operation proceeds from start step 902 to step 904. In step 904, the communications device broadcasts, over a wireless communications channel, speech synthesis information, said speech synthesis information including at least one of: i) a phonetic representation of speech and ii) a text representation of speech and speech synthesizer control information. Operation proceeds from step 904 to step 906. In step 906, the communications device broadcasts an audio signal corresponding to said speech synthesis information.

In some embodiments, the speech synthesis information includes at least one synthesis parameter from a group of synthesis parameters, said group of synthesis parameters including tone, gender, volume, and speech rate. In some embodiments, the speech synthesis information includes information communicating at least one of: the content of a portion of a book and weather information.

In some embodiments, speech synthesis information corresponding to a portion of the broadcast information is transmitted prior to the transmission of the corresponding broadcast audio signal. In various embodiments, the speech synthesis information includes information to be used in synthesizing speech at least a portion of which is already present in the corresponding broadcast audio signal.

In various embodiments, the speech synthesis information includes information to be used in synthesizing speech at least a portion of which is not already present in the corresponding broadcast audio signal. In some embodiments, the speech synthesis information includes information to be used in synthesizing speech which communicates information not present in the corresponding broadcast audio signal, said speech synthesis information providing at least one of: author, title, copyright and digital rights management information. In various embodiments, the speech synthesis information includes information to be used in synthesizing speech which communicates information not present in the corresponding audio signal, said speech synthesis information providing at least some news information not included in the corresponding audio information, said news information including at least one of: regional weather information, traffic information, headline news information and stock market information.

In some embodiments, the speech synthesis information includes information for synthesizing speech conveying in a different language than said audio broadcast, at least some of said information conveyed by the audio broadcast signal and the corresponding information for synthesizing speech being the same.

Figure 10:
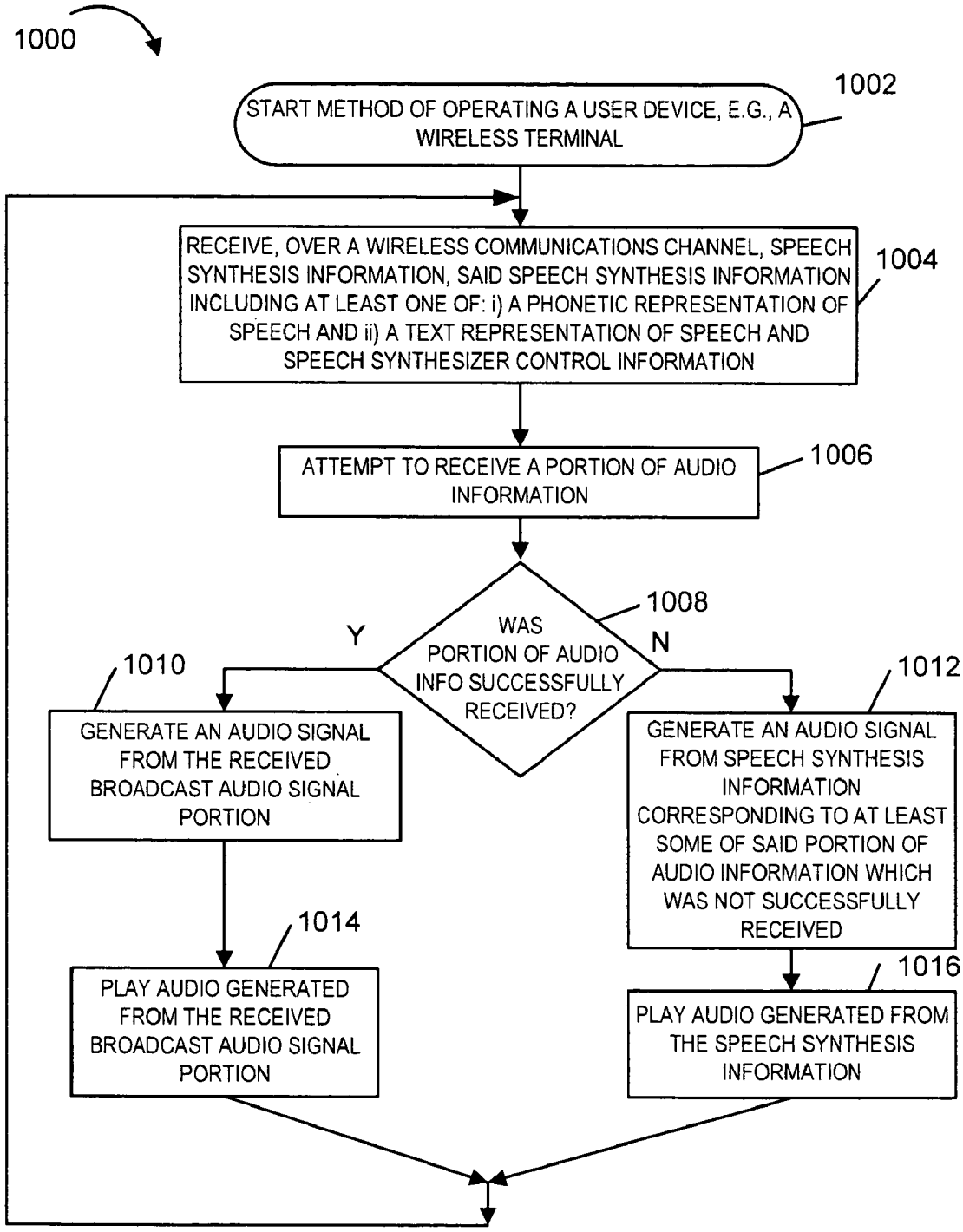
FIG. 10 is a drawing of a flowchart of an exemplary method of operating a user device, e.g., a wireless terminal such as a mobile node in accordance with various embodiments.

FIG. 10 is a drawing of a flowchart 1000 of an exemplary method of operating a user device, e.g., a wireless terminal such as a mobile node in accordance with various embodiments. Operation starts in step 1002, where the user device is powered on and initialized. Operation proceeds from step 1002 to step 1004. In step 1004, the user device receives, over a wireless communications channel, speech synthesis information, said speech synthesis information including at least one of: i) a phonetic representation of speech and ii) a text representation of speech and speech synthesizer control information. Operation proceeds from step 1004 to step 1006. In step 1006, the user device attempts to recover a portion of audio information. Operation proceeds from step 1006 to step 1008, where the user device determines whether or not the potion of audio information was successfully recovered. If the portion of audio information was successfully recovered operation proceeds from step 1008 to step 1010; if the portion of audio information was not successfully recovered operation proceeds from step 1008 to step 1012.

In step 1010, the user device generates an audio signal from the received broadcast audio signal portion. Operation proceeds from step 1010 to step 1014, where the user device plays the audio generated from the received broadcast audio signal portion.

In step 1012, the user device generates an audio signal from speech synthesis information corresponding to at least some of said portion of audio information which was not successfully received. Operation proceeds from step 1012 to step 1016, where the user device plays audio generated from the speech synthesis information.

Operation proceeds from step 1014 or step 1016 to step 1004, where the user device receives additional speech synthesis information.

Figure 11:
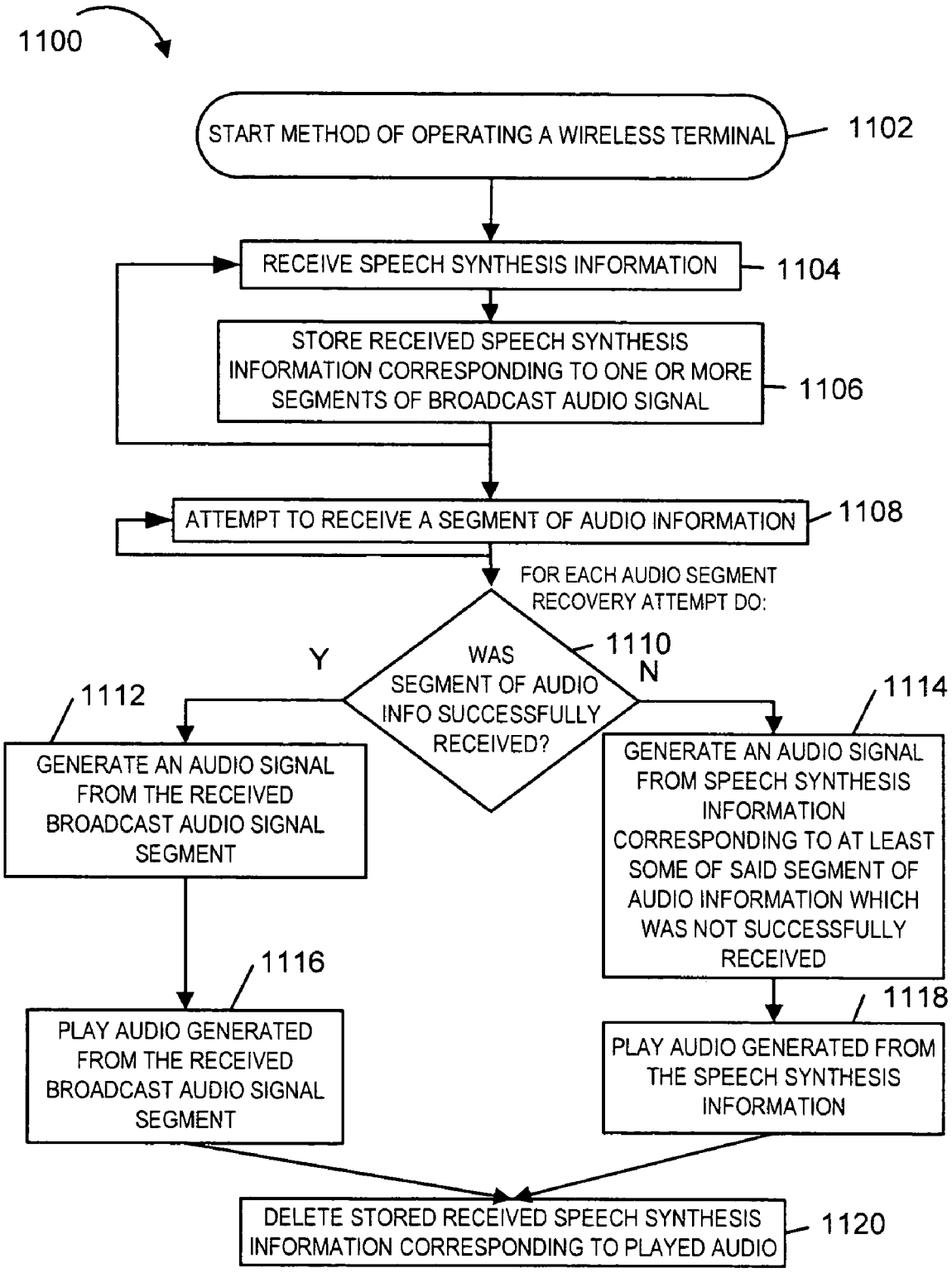
FIG. 11 is a drawing of a flowchart of an exemplary method of operating a wireless terminal in accordance with various embodiments.

FIG. 11 is a drawing of a flowchart 1100 of an exemplary method of operating a wireless terminal in accordance with various embodiments. Operation starts in step 1102, where the wireless terminal is powered on and initialized. Operation proceeds from start step 1102 to step 1104, where the wireless terminal receives speech synthesis information. Operation proceeds from step 1104 to step 1106, where the wireless terminal stores speech synthesis information corresponding to one or more segments of broadcast audio signal. Operation proceeds from step 1106 to step 1104 and step 1108. Thus the operations of steps 1104 and 1106 are repeated on an ongoing basis.

In step 1108, the wireless terminal attempts to receive a segment of audio information. Step 1108 is performed on an ongoing basis. For each audio segment recovery attempt, operation proceeds from step 1108 to step 1110.

In step 1110, the wireless terminal determines whether or not the segment of broadcast audio information was successfully received by the wireless terminal. If the segment of broadcast audio information was successfully recovered, then operation proceeds from step 1110 to step 1112; if the segment of broadcast audio information was not successfully recovered, operation proceeds from step 1110 to step 1114.

In step 1112, the wireless terminal generates an audio signal from the received broadcast audio signals and in step 1116 plays the audio generated from the received broadcast audio signal segment.

In step 1114, the wireless terminal generates an audio signal from speech synthesis information corresponding to at least some of the segment of audio information which was not successfully received. Operation proceeds from step 1114 to step 1118 in which the wireless terminal plays audio generated from the speech synthesis information. Operation proceeds from step 1116 or step 1118 to step 1120, where the wireless terminal deletes stored received speech synthesis information corresponding to the played segment.

Figure 12:
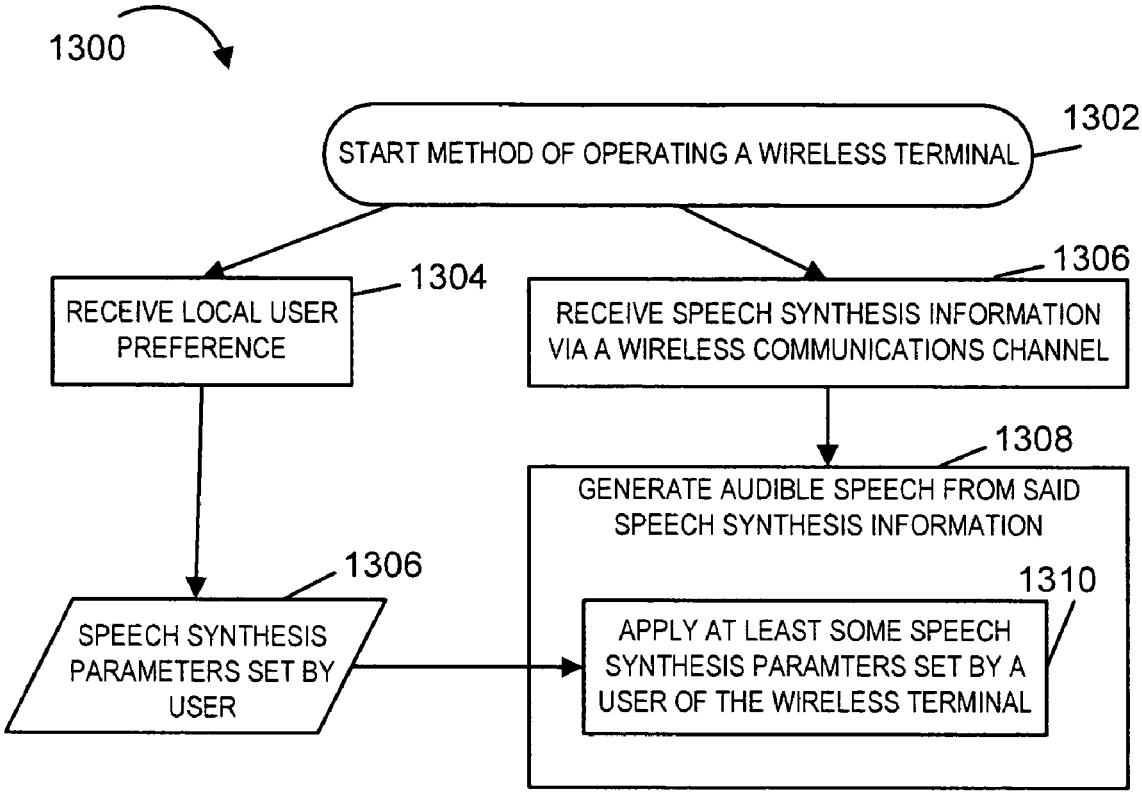
FIG. 12 is a flowchart of an exemplary method of operating a wireless terminal in accordance with various embodiments.

FIG. 12 is a flowchart 1300 of an exemplary method of operating a wireless terminal in accordance with various embodiments. Operation starts in step 1302, where the wireless terminal is powered on and initialized. Operation proceeds from start step 1302 to step 1306 and 1304. In step 1306, the wireless terminal receives speech synthesis information via a wireless communications channel. In step 1304, the wireless terminal receives local user preference, e.g., a user of the wireless terminal performs one or more selections regarding speech synthesis operation, resulting in speech synthesis parameters set by user 1306. In some embodiments at least some of the selected speech synthesis parameters indicate at least one of: a dialect, a speech rate, and a voice gender.

Operation proceeds from step 1306 to step 1308. In step 1308, the wireless terminal generates audible speech from said speech synthesis information. Step 1308 includes sub-step 1310. In sub-step 1310, the wireless terminal applies at least some speech synthesis parameters set by a user of the wireless terminal.

Figure 13:
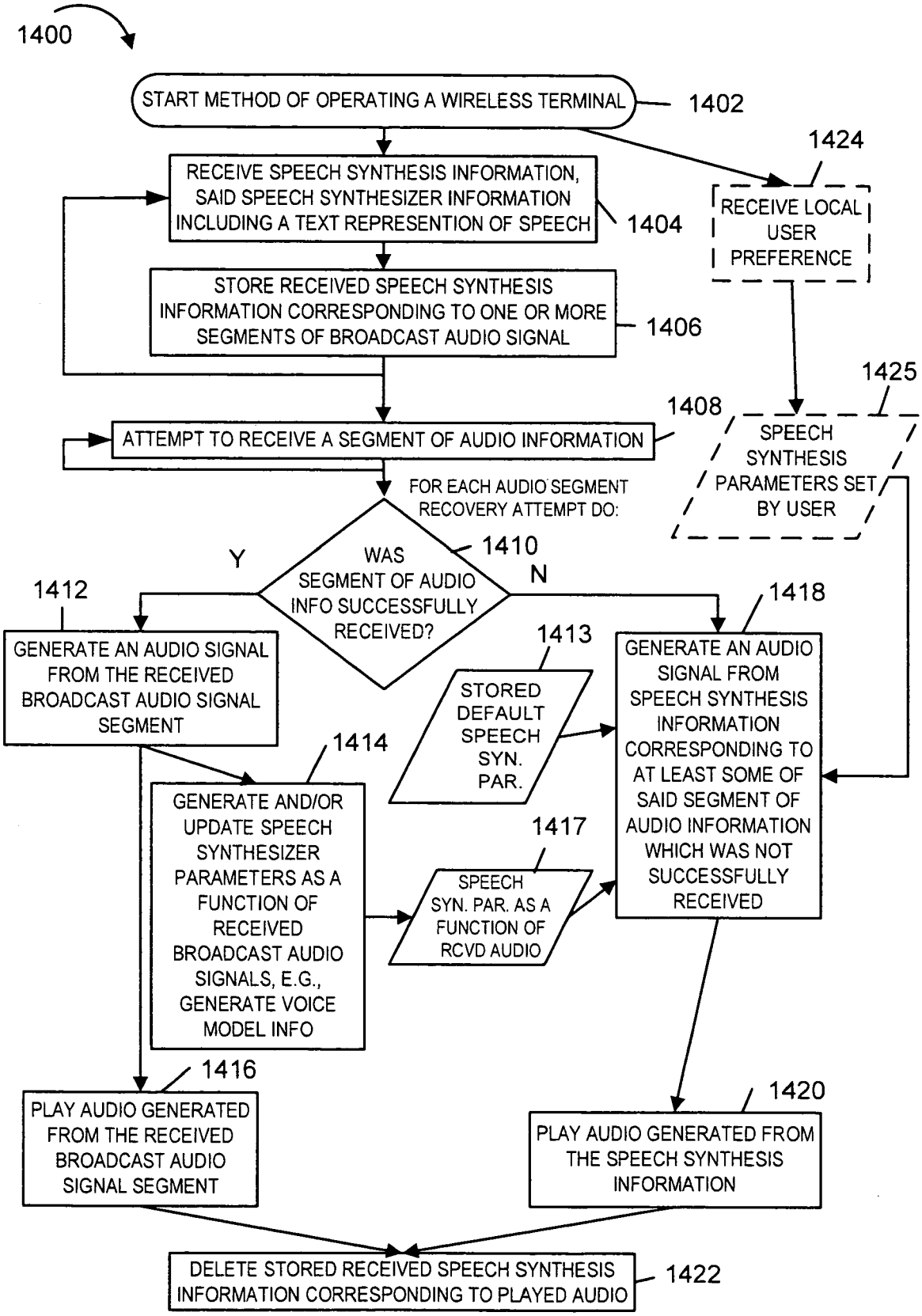
FIG. 13 is a drawing of a flowchart of an exemplary method of operating a wireless terminal in accordance with various embodiments.

FIG. 13 is a drawing of a flowchart 1400 of an exemplary method of operating a wireless terminal in accordance with various embodiments. Operation starts in step 1402, where the wireless terminal is powered on and initialized. Operation proceeds from start step 1402 to step 1404, where the wireless terminal receives speech synthesis information, said speech synthesizer information including a text representation for speech. In some embodiments, in addition to or in place of received broadcast speech synthesis information including a text representation for speech, the wireless terminal receives broadcast speech synthesis information including a phonetic representation for speech. In some embodiments, the wireless terminal receives broadcast speech synthesis information including speech synthesizer control parameter information. In some embodiments operation also proceeds from step 1402 to step 1424, where the wireless terminal receives local user preferences resulting in speech synthesis parameters set by the user 1425.

Operation proceeds from step 1404 to step 1406, where the wireless terminal stores received speech synthesis information corresponding to one or more segments of broadcast audio signal. The operations of steps 1404 and 1406 are preformed on a recurring basis. Operation proceeds from step 1406 to step 1408, which is performed on a recurring basis. In step 1408, the wireless terminal attempts to receive a segment of broadcast audio information. For each audio segment recovery attempt, operation proceeds from step 1408 to step 1410.

In step 1410, the wireless terminal determines whether or not the audio segment was successfully received. If the broadcast audio segment was successfully received, then operation proceeds from step 1410 to step 1412. If the audio segment was not successfully received, then operation proceeds from step 1410 to step 1418.

In step 1412, the wireless terminal generates an audio signal from the received broadcast audio signal segment. Operation proceeds from step 1412 to step 1416 and step 1414. In step 1414, the wireless terminal generates and/or updates speech synthesizer parameters as a function of the received broadcast audio signals, e.g., generating voice model information. The result of step 1414 is speech synthesizer parameters as a function of received audio 1417. Returning to step 1416, in step 1416, the wireless terminal plays audio generated from the received broadcast audio signal segment. Operation proceeds from step 1416 to step 1422.

Returning to step 1418, in step 1418, the wireless terminal generates an audio signal from speech synthesis information corresponding to at least some of the segment of broadcast audio information which was not successfully received. Step 1418 uses at least one of stored default speech synthesis parameters 1413, speech synthesis parameters set by user 1425 and speech synthesis parameters as a function of received audio 1417, in generating the audio signal. In some embodiments, at least some of the speech synthesis parameters utilized in step 1418 are filtered parameters, e.g., with the filtered parameters being readjusted in response to a quality level associated with a generated voice model based on received broadcast audio signals.

Operation proceeds from step 1418 to step 1420. In step 1420, the wireless terminal plays audio generated from the speech synthesis information. Operation proceeds from step 1420 to step 1422. In step 1422, the wireless terminal deletes stored received speech synthesis information corresponding to the played audio.

In various embodiments, at least some of the speech synthesis parameters indicate at least one of: a dialect, a voice level, an accent, a speech rate, a voice gender, and a voice model.

In various embodiments, the wireless terminal is a portable communications device including an OFDM receiver. In some such embodiments at least one of speech synthesis information and broadcast audio information is communicated via OFDM signals. In some such embodiments both said speech synthesis information and broadcast audio information are communicated via OFDM signals, e.g., via different communications channels.

Figure 14:
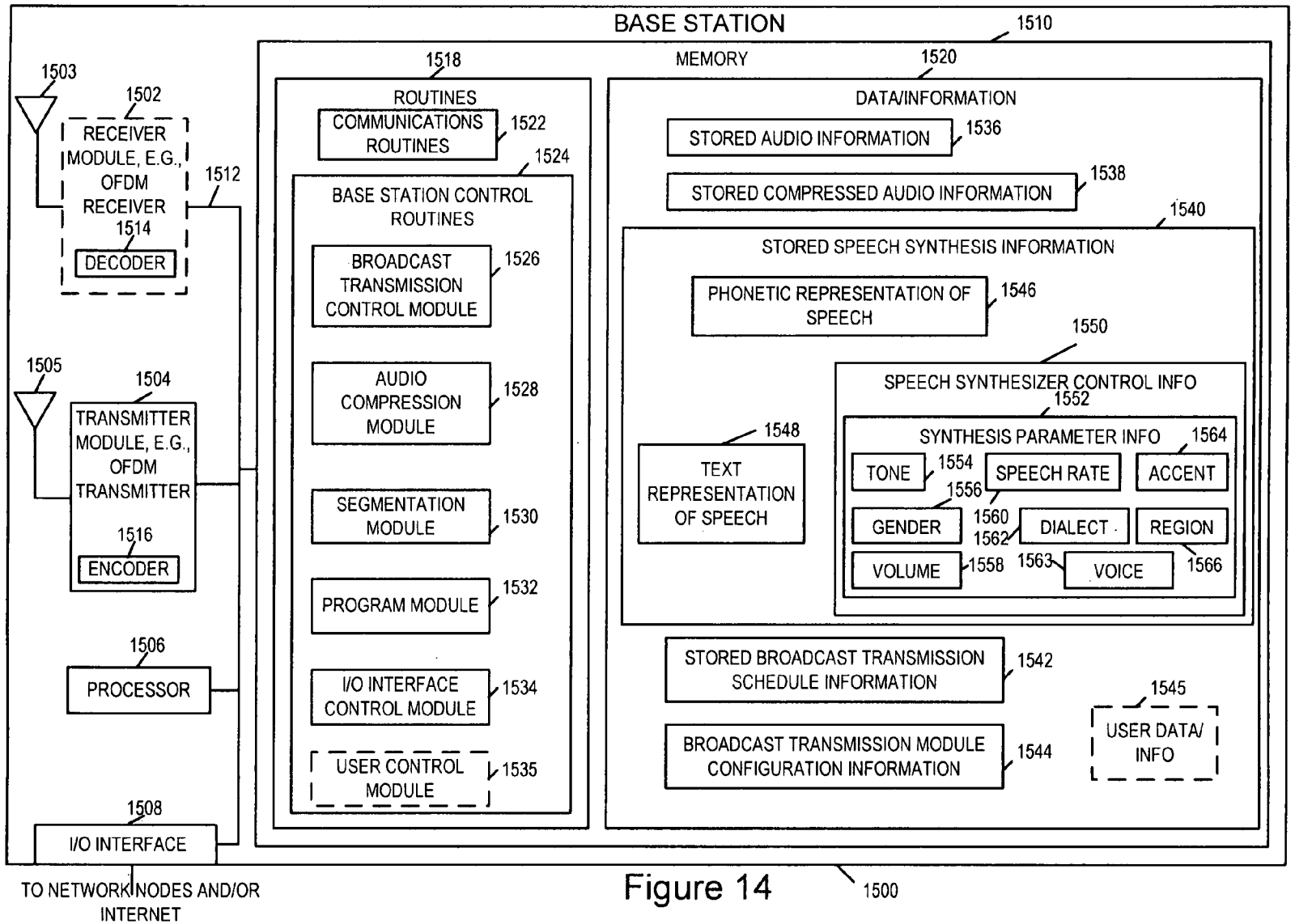
FIG. 14 is a drawing of an exemplary base station implemented in accordance with various embodiments.

FIG. 14 is a drawing of an exemplary base station 1500 implemented in accordance with various embodiments. Exemplary base station 1500 may be the exemplary base station 12 of FIG. 1. Exemplary base station 1500 may an exemplary base station implementing the method of FIG. 9.

Exemplary base station 1500 includes a receiver module 1502, a transmitter module 1504, a processor 1506, an I/O interface 1508, and a memory 1510 coupled together via a bus 1512 over which the various elements interchange data and information. Memory 1510 includes routines 1518 and data/information 1520. The processor 1506, e.g., a CPU, executes the routines 1518 and uses the data/information 1520 in memory 1510 to control the operation of the base station 1500 and implement methods.

Receiver module 1502, e.g., an OFDM receiver, is coupled to receive antenna 1503 via which the base station 1500 receives uplink signals from wireless terminals. In some embodiments, uplink signals include registration request signals, requests for broadcast channel availability and/or programming information, requests for access to broadcast channels, requests for key information, wireless terminal identity information, user/device parameter information, other state information, and/or pay per view handshaking information. In some embodiments, e.g., some embodiments in which the base station supports downlink broadcast signaling to wireless terminals but does not support uplink signaling reception from the wireless terminals, receiver module 1502 is not included. Receiver module 1502 includes decoder 1514 for decoding at least some of the received uplink signals.

Transmitter module 1504, e.g., an OFDM wireless transmitter, is coupled to transmit antenna 1505 via which the base station transmits downlink signals to wireless terminal. Transmitter module 1504 includes an encoder 1516 for encoding at least some of the downlink signals. Transmitter module 1504 transmits at least some of stored speech synthesis information 1540 over a wireless communications channel. Transmitter module 1504 also transmits at least some of the stored compressed audio information 1538 over a wireless communications channel. Downlink signals include, e.g., timing/synchronization signals, broadcast signals conveying compressed audio information and broadcast signals conveying speech synthesis information. In some embodiments, the downlink signals also include registration response signals, key information, programming availability and/or programming directory information, and/or handshaking signals.

In some embodiments, both the compressed audio information and speech synthesis information are communicated using the same technology, e.g., OFDM signaling. In some embodiments, transmitter module 1504 supports a plurality of signaling technologies, e.g., OFDM and CDMA. In some such embodiments, one of the compressed audio information and speech synthesis information is communicated using one type of technology and the other is communicated using a different technology.

I/O interface 1508 couples the base station to network nodes, e.g., routers, other base stations, content provider servers, etc., and/or the Internet. Program information to be broadcast via base station 1500 is received via interface 1508.

Routines 1518 include a communications routine 1522, and base station control routines 1524. The communications routine 1522 implements the various communications protocols used by the base station 1500. Base station control routines 1524 includes a broadcast transmission control module 1526, an audio compression module 1528, a segmentation module 1530, a program module 1532, an I/O interface control module 1534, and, in some embodiments, a user control module 1535.

The broadcast transmission control module 1526 controls the transmission of stored compressed audio information 1538 and stored speech synthesis information 1540. The broadcast transmission control module 1526 controls the transmission of stored compressed audio information and stored speech synthesis information according to the broadcast transmission schedule information 1542. At least some of the broadcast compressed audio information corresponds to at least some of the broadcast speech synthesis information. In some embodiments, the broadcast transmission control module 1526 is configured, in accordance with the broadcast transmission module configuration information 1544, to control the transmission of the speech synthesis information corresponding to a portion of the broadcast compressed audio information such that the speech synthesis information is transmitted prior to the transmission of the corresponding broadcast compressed audio signal, e.g., a segment of speech synthesis information is controlled to be transmitted prior to a corresponding segment of compressed audio information.

Audio compression module 1528 converts audio information 1536 to compressed audio information 1538. In some embodiments, compressed audio information is received directly via I/O interface 1508, thus bypassing module 1528.

Segmentation module 1530 controls operations related to segmentation of stored compressed audio information 1538 and segmentation of stored speech synthesis information 1540 to be transmitted, e.g., the segmentation of received program information from a content provider into transmission segments. Program module 1532 controls tracking of program content onto various broadcast wireless communications channels being used by base station 1500 and program directory related operations.

I/O interface control module 1534 controls the operation of I/O interface 1508, e.g., receiving program content to be subsequently broadcast. User control module 1535, included in some embodiments with receiver module 1502, controls operations related to wireless terminal registration, wireless terminal access, key transmission, pay per view, directory delivery, and handshaking operations.

Data/information 1520 includes stored audio information 1536, stored compressed audio information 1538, stored speech synthesis information 1540, stored broadcast transmission schedule information 1542, broadcast transmission module configuration information 1544, and, in some embodiments, user data/information 1545.

The stored speech synthesis information 1540 includes phonetic representation of speech information 1546, text representation of speech 1548 and speech synthesizer control information 1550. The speech synthesizer control information 1550 includes synthesis parameter information 1552. The speech synthesizer parameter information 1552 includes tone information 1554, gender information 1556, volume information 1558, speech rate information 1560, dialect information 1562, voice information 1563, accent information 1564, and region information 1566.

In some embodiments, the stored speech synthesis information 1540 includes information communicating at least one of the content of a portion of a book and weather information. In some embodiments, the stored speech synthesis information 1540 includes information communicating at least one of the content of a portion of a book, a portion of an article, an editorial commentary, news information, weather information, and an advertisement.

In various embodiments, the speech synthesis information 1540 includes information to be used in synthesizing speech at least a portion of which is already present in the corresponding broadcast audio signal. In various embodiments, the speech synthesis information 1540 includes information to be used in synthesizing speech at least a portion of which is not already present in the corresponding broadcast audio signal. In some embodiments, the speech synthesis information 1540 include information to be used in synthesizing speech which communicates information not present in the corresponding broadcast audio signal, said speech synthesis information providing at least one of: author, title, copyright and digital rights management information. In some embodiments, the speech synthesis information 1540 include information to be used in synthesizing speech which communicates information not present in the corresponding broadcast audio signal, said speech synthesis information providing at least some news information not included in the corresponding audio information, said news information including at least one of: regional weather information, local weather information, traffic information, headline news information and stock market information.

In some embodiments, the speech synthesis information includes information for synthesizing speech conveying in a different language than said audio broadcast, at least some of the information conveyed by the audio broadcast signal and the corresponding information for synthesizing speech being the same.

User data/information 1545, included in some embodiments, includes, e.g., registration information, access information, keys, accounting information such as session tracking information, program selection information, cost information, charge information, user identification information and other user state information. User data/information 1545 includes information corresponding to one or more wireless terminals using a base station 1500 attachment point.

Figure 15:
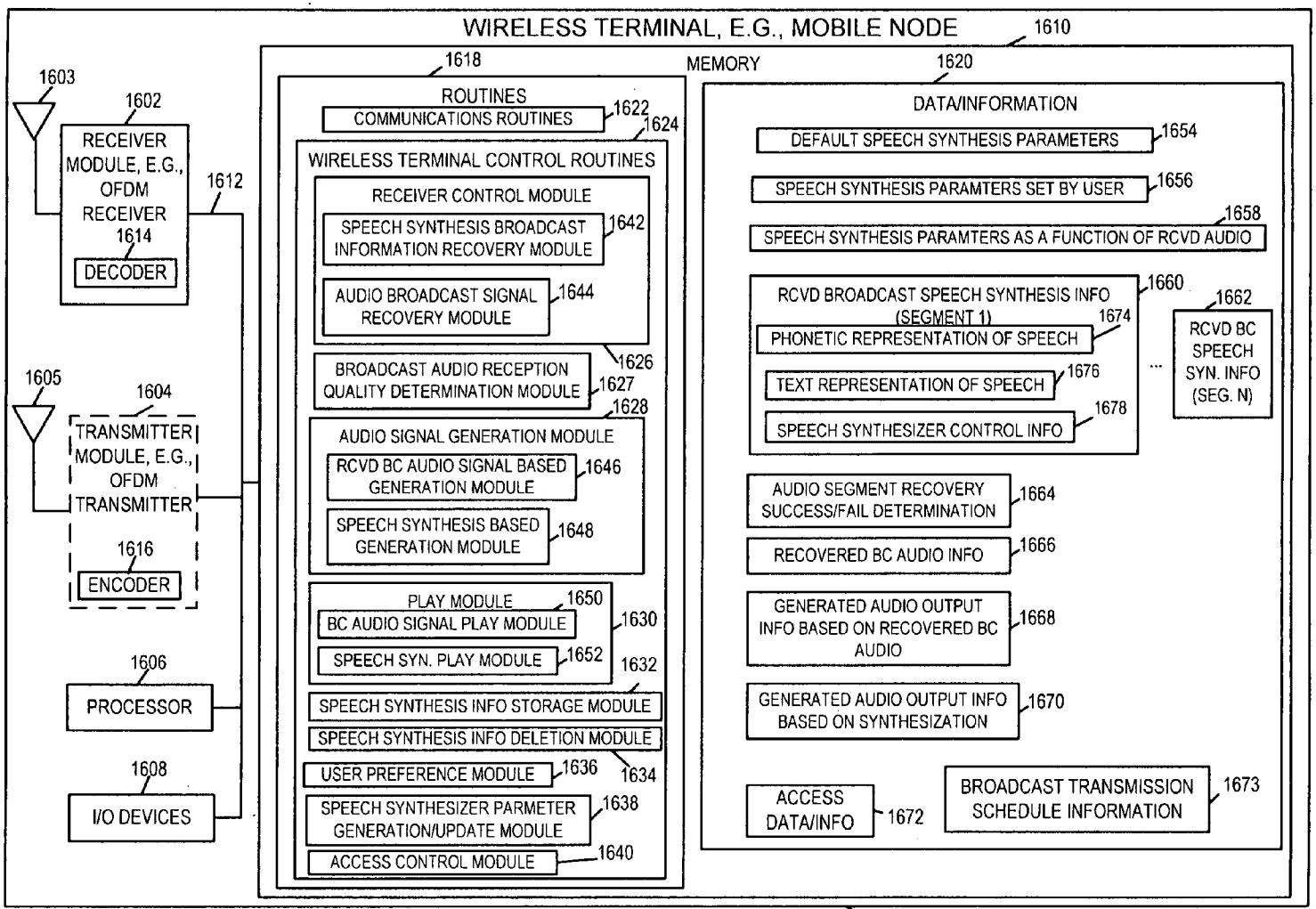
FIG. 15 is a drawing of an exemplary wireless terminal, e.g., mobile node, implemented in accordance with various embodiments.

FIG. 15 is a drawing of an exemplary wireless terminal 1600, e.g., mobile node, implemented in accordance with various embodiments. Exemplary wireless terminal 1600 may be any of the wireless terminals of the system of FIG. 1. Exemplary wireless terminal 1600 may be any of the wireless terminals implementing a method in accordance with FIG. 10, 11, 12 or 13.

Exemplary wireless terminal 1600 includes a receiver module 1602, a transmitter module 1604, a processor 1606, I/O devices 1608, and memory 1610 coupled together via a bus 1612 over which the various elements may interchange data and information. The memory 1610 includes routines 1618 and data/information 1620. The processor 1606, e.g., a CPU, executes the routines 1618 and uses the data/information 1620 in memory 1610 to control the operation of the wireless terminal and implement methods.

Receiver module 1602, e.g., and OFDM receiver, receives downlink signals from base stations, e.g., base station 1500, via receive antenna 1603. Received downlink signals include timing/synchronization signals, broadcast signals conveying audio signals, e.g., compressed audio signals, broadcast signals conveying speech synthesis information. In some embodiments, the received signals may include registration response signals, key information, broadcast program directory information, handshaking information and/or access information. In some embodiments, the receiver module 1602 supports a plurality of types of technologies, e.g., OFDM and CDMA. Receiver module 1602 includes a decoder 1614 for decoding at least some of the received downlink signals.

Transmitter module 1604, e.g., an OFDM transmitter, is coupled to transmit antenna 1605 via which the wireless terminal transmits uplink signals to base stations. Uplink signals include, e.g., registration request signals, request for access to broadcast channel, request for keys, e.g., encryption keys, request for broadcast directory information, requests for selection options concerning a broadcast program, session information, accounting information, identification information, etc. In some embodiments, the same antenna is used for receiver and transmitter, e.g., in conjunction with a duplexer module. In some embodiments, the wireless terminal 1600 does not include a transmitter module 1604 and the wireless terminal receives downlink broadcast information but does not communicate uplink signals to the base station from which it is receiving the downlink broadcast signals.

I/O devices 1608, allow a user to input data/information, select options, e.g., including control parameters used in the speech synthesis, output data/information, e.g., hear an audio output. I/O devices 1608, are, e.g., keypad, keyboard, touchscreen, microphone, speaker, display, etc. In some embodiments, a speech synthesizer is implemented at least in part in hardware and is included as part of I/O devices 1608.

Routines 1618 include communications routines 1622 and wireless terminal control routines 1624. The communications routines 1622 implement various communications protocols used by the wireless terminal 1600. Wireless terminal control routines 1624 include a receiver control module 1626, a broadcast audio reception quality determination module 1627, an audio signal generation module 1628, a play module 1630, a speech synthesis information storage module 1632, a speech synthesis information deletion module 1634, a user preference module 1636, a speech synthesizer parameter generation/update module 1638, and an access control module 1640.

Receiver control module 1624 control receiver module 1602 operation. Receiver control module 1626 includes a speech synthesis broadcast information recovery module 1642 and an audio broadcast signal recovery module 1644. Speech synthesis broadcast information recovery module 1642 control the wireless terminal to receive broadcast speech information in accordance with the broadcast schedule information 1673. Speech synthesis information storage module 1632 stores information recovered from module 1642, e.g., as received broadcast speech synthesis information (segment 1) 1660, . . . , received broadcast speech synthesis information (segment N) 1662. Audio broadcast signal recovery module 1644 controls the receiver module 1602 to attempt to receive broadcast audio signals, e.g., corresponding to a segment, in accordance with the broadcast schedule information 1673. Broadcast audio reception quality determination module 1627 determines, e.g., for an attempted reception of a segment of broadcast compressed audio information, whether or not the recovery was successful. The result of the recovery is audio segment recovery success/fail determination 1664 and is used to direct operation flow, e.g., to one of the received broadcast audio signal based generation module 1646 in the case of a success or to the speech synthesis based generation module 1648 in the case of a failure. Thus module 1627 acts as a switching module. For example, the failure may be due to a temporarily weak or lost signal due to traveling through a tunnel, underpass, or dead spot.

Audio signal generation module 1628 includes a received broadcast audio signal based generation module 1646 and a speech synthesis based generation module 1648. The received broadcast audio signal based generation module 1646 is, e.g., a decompression module and signal generation module which generates signal to drive the output speaker device. Recovered broadcast audio information 1666 is an input to module 1646, while generated audio output information based on recovered broadcast audio 1668 is an output of module 1646. Speech synthesis based generation module 1648, e.g., a speech synthesizer, generates audio output signal information based on synthesis 1670, using at least some of received broadcast speech synthesis information, e.g., some of information 1660. In some embodiments, during some times, the speech synthesis based generation module 1648 also uses at least one of: default speech synthesis parameters 1654, speech synthesis parameters set by user 1656, and speech synthesis parameters as a function of received broadcast audio 1658.

Play module 1630 includes a broadcast audio signal play module 1650 and a speech synthesis play module 1652. Broadcast audio signal play module 1650 is coupled to generation module 1646 and uses the information 1668 to play audio, e.g., corresponding to successfully recovered broadcast audio segment. Speech synthesis play module 1652 is coupled to module 1648 and uses information 1670 to play audio generated from speech synthesis to the user, e.g., when corresponding broadcast audio signals were not successfully received.

Speech synthesis information deletion module 1634 deletes one of information (1660, . . . , 1662) corresponding to a particular segment after audio has been played to a user corresponding to the segment. User preference module 1636 receives local user preferences, e.g., obtained from a user of wireless terminal 1600 selecting items on a menu, to set at least some of the speech synthesis parameters to be used by module 1648. Speech synthesis parameters set by user 1656 is an output of user preference module 1636. Speech synthesizer parameter generation/update module 1638 generates and/or updates at least some of the speech synthesis parameters used by module 1648, based on received broadcast audio information. For example, module 1638, in some embodiments, generates parameters of a voice model to be used by the synthesizer such that the synthesized voice, implemented during outages of the broadcast audio signal reception, closely resembles the broadcast audio voice. Speech synthesis parameters as a function of received audio 1658 is an output of module 1638. Access control module 1640 controls the selected broadcast channels from which data is being recovered. In some embodiments, access control module 1640 also generates access requests, request for keys, request for directory information, identifies and generates pay for view requests, processes responses, and/or performs handshaking operations with a base station transmitting broadcast programs.

Data/information 1620 includes default speech synthesis parameters 1654, speech synthesis parameters set by user 1656, speech synthesis parameters as a function of received broadcast audio 1658, received broadcast speech synthesis information (segment 1) 1660, . . . , received broadcast speech synthesis information (segment N) 1662, audio segment recovery success/fail determination 1664, recovered broadcast audio information 1666, generated audio output information based on recovered broadcast audio 1668, generated audio output information based on synthesis 1670, access data/information 1672, and broadcast schedule information 1673.

Received broadcast speech synthesis information 1660 includes phonetic representation of speech 1674, text representation of speech 1676, and speech synthesizer control information 1678. Speech synthesizer control information 1678 includes synthesis parameter information. The synthesis parameter information included in information 1678,

1654, 1656, and/or 1658 includes at least one of: tone information, gender information, volume information, speech rate information, accent information, dialect information, region information, voice information, and ethnicity information.

In some embodiments, the speech synthesis information (1660, . . . , 1662) includes information communicating at least one of the content of a portion of a book and weather information. In some embodiments, the speech synthesis information (1660, . . . , 1662) includes information communicating at least one of the content of a portion of a book, a portion of an article, an editorial commentary, news information, weather information, and an advertisement.

In various embodiments, the speech synthesis information (1660, . . . , 1662) includes information to be used in synthesizing speech at least a portion of which is already present in the corresponding broadcast audio signal. In various embodiments, the speech synthesis information (1660, . . . , 1662) includes information to be used in synthesizing speech at least a portion of which is not already present in the corresponding broadcast audio signal. In some embodiments, the speech synthesis information (1660, . . . , 1662) include information to be used in synthesizing speech which communicates information not present in the corresponding broadcast audio signal, said speech synthesis information providing at least one of: author, title, copyright and digital rights management information. In some embodiments, the speech synthesis information (1660, . . . 1662) includes information to be used in synthesizing speech which communicates information not present in the corresponding broadcast audio signal, said speech synthesis information providing at least some news information not included in the corresponding audio information, said news information including at least one of: regional weather information, local weather information, traffic information, headline news information and stock market information.

In some embodiments, the speech synthesis information (1660, . . . 1662) includes information for synthesizing speech conveying in a different language than said audio broadcast, at least some of the information conveyed by the audio broadcast signal and the corresponding information for synthesizing speech being the same.

In various embodiments nodes described herein are implemented using one or more modules to perform the steps corresponding to one or more methods, for example, signal processing, speech synthesis information processing, and/or speech synthesis parameter and timing control steps. Thus, in some embodiments various features are implemented using modules or controllers. Such modules or controllers may be implemented using software, hardware or a combination of software and hardware. Many of the above described methods or method steps can be implemented using machine executable instructions, such as software, included in a machine readable medium such as a memory device, e.g., RAM, floppy disk, etc. to control a machine, e.g., general purpose computer with or without additional hardware, to implement all or portions of the above described methods, e.g., in one or more nodes. Accordingly, among other things, various embodiments are directed to a machine-readable medium including machine executable instructions for causing a machine, e.g., processor and associated hardware, to perform one or more of the steps of the above-described method(s).

Numerous additional variations on the methods and apparatus of various embodiments are described above will be apparent to those skilled in the art in view of the above description. Such variations are to be considered within the scope. The methods and apparatus may be, and in various embodiments are, used with CDMA, orthogonal frequency division multiplexing (OFDM), or various other types of communications techniques which may be used to provide wireless communications links between access nodes and mobile nodes. In various embodiments the mobile nodes, or other broadcast receiving devices, may be implemented as notebook computers, personal data assistants (PDAs), or other portable or non-portable devices including receiver/transmitter circuits and logic and/or routines, for implementing the methods.

What is claimed is:

1. A method of operating a wireless terminal, comprising:

receiving speech synthesis information from a wireless communications channel; and generating, via the wireless terminal, audible speech from said speech synthesis information, wherein generating audible speech comprises applying at least some speech synthesis parameters set by a user of the wireless terminal.

2. The method of claim 1, wherein said received speech synthesis information including at least one of: i) a phonetic representation of speech and ii) a text representation of speech.

3. The method of claim 2, wherein said received speech synthesis information further includes at least some speech synthesizer control information.

4. The method of claim 2, further comprising, prior to applying at least some speech synthesis parameter set by a user of the wireless terminal receiving from a user of the wireless terminal user preference information setting said at least some speech synthesis parameters.

5. The method of claim 4, wherein said at least some speech synthesis parameters set by a user of said wireless terminal indicate at least one of: a dialect, a speech rate, a voice gender, a voice model, an accent, a tone, and a language.

6. The method of claim 5, wherein said received speech synthesis information from a wireless communications channel includes at least one of the content of a portion of a book and weather information.

7. A communications device comprising:

a wireless receiver module for receiving broadcast speech synthesis information;

a user preference module receiving user preference settings of speech synthesizer control parameters; and audio output generation module for generating audio output using said received broadcast speech synthesis information and said speech synthesizer control parameters set in response to said user preference.

8. The communications device of claim 7, wherein said speech synthesizer control parameters indicate at least one of a dialect, a speech rate, a voice gender, a voice model, and accent, a tone, and a language.

9. The communications device of claim 7, wherein said wireless terminal receiver module is an OFDM receiver.

10. The communications device of claim 9, wherein said OFDM receiver receives broadcast speech synthesis information including a text representation of speech over a first OFDM communications channel and wherein the OFDM receiver receives compressed audio over a second OFDM communications channel.

11. The communications device of claim 10, wherein at least some of said broadcast speech synthesis information including a text representation represents the same information as a portion of broadcast compressed audio signals being transmitted to which said wireless terminal is attempting recovery.

12. A communications device comprising:

means for receiving broadcast speech synthesis information;

means for receiving user preference settings of speech synthesizer control parameters; and means for generating audio output using said received broadcast speech synthesis information and said speech synthesizer control parameters set in response to said user preference.

13. The communications device of claim 12, wherein said speech synthesizer control parameters indicate at least one of; a dialect, a speech rate, a voice gender, a voice model, and accent, a tone, and a language.

14. The communications device of claim 12, wherein said means for receiving is an OFDM receiver.

15. The communications device of claim 14, wherein said OFDM receiver receives broadcast speech synthesis information including a text representation of speech over a first OFDM communications channel and wherein the OFDM receiver receives compressed audio over a second OFDM communications channel.

16. The communications device of claim 15, wherein at least some of said broadcast speech synthesis information including a text representation represents the same information as a portion of broadcast compressed audio signals being transmitted to which said wireless terminal is attempting recovery.

17. A non-transitory computer readable medium having machine executable instructions stored thereon for controlling a wireless terminal to perform a method, the method comprising:

receiving speech synthesis information from a wireless communications channel; and generating audible speech from said speech synthesis information, wherein generating audible speech comprises applying at least some speech synthesis parameters set by a user of the wireless terminal.

18. The computer readable medium of claim 17, wherein said received speech synthesis information includes at least one of i) a phonetic representation of speech and ii) a text representation of speech.

19. The computer readable medium of claim 18, wherein said received speech synthesis information further includes at least some speech synthesizer control information.

20. The computer readable medium of claim 18, further embodying instructions for, prior to applying at least some speech synthesis parameter set by a user of the wireless terminal, receiving from a user of the wireless terminal user preference information setting said at least some speech synthesis parameters.

21. The computer readable medium of claim 20, wherein said at least some speech synthesis parameters set by a user of said wireless terminal indicate at least one of: a dialect, a speech rate, a voice under, a voice model, an accent, a tone, and a language.

22. The computer readable medium of claim 21, wherein said received speech synthesis information from a wireless communications channel includes at least one of the content of a portion of a book and weather information.

* * * * *

UNITED STATES PATENT AND TRADEMARK OFFICE

CERTIFICATE OF CORRECTION

PATENT NO. : 7,822,606 B2
APPLICATION NO. : 11/487261
DATED : October 26, 2010
INVENTOR(S) : Lane et al.

It is certified that error appears in the above-identified patent and that said Letters Patent is hereby corrected as shown below:

Column 20, line 50, claim 8: “of” to read as --of:--

Column 20, line 51, claim 8: “and accent” to read as --an accent--

Column 21, line 11, claim 13: “of;” to read as --of:--

Column 21, line 12, claim 13: “and accent” to read as --an accent--

Column 22, line 22, claim 21: “a voice under” to read as --a voice gender,--

Signed and Sealed this
Thirty-first Day of July, 2012

David J. Kappos

David J. Kappos
*Director of the United States Patent and Trademark Office*